US007734015B2

(12) United States Patent
Okada et al.

(10) Patent No.: US 7,734,015 B2
(45) Date of Patent: Jun. 8, 2010

(54) X-RAY TUBE AND X-RAY SOURCE INCLUDING SAME

(75) Inventors: Tomoyuki Okada, Hamamatsu (JP); Tutomu Inazuru, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 57 days.

(21) Appl. No.: 12/089,072

(22) PCT Filed: Oct. 4, 2006

(86) PCT No.: PCT/JP2006/319868

§ 371 (c)(1),
(2), (4) Date: May 14, 2008

(87) PCT Pub. No.: WO2007/043410

PCT Pub. Date: Apr. 19, 2007

(65) Prior Publication Data

US 2009/0238340 A1 Sep. 24, 2009

(30) Foreign Application Priority Data

Oct. 7, 2005 (JP) ..... 2005-295705

(51) Int. Cl.
*H01J 35/14* (2006.01)

(52) U.S. Cl. ..... 378/138; 378/122; 378/143

(58) Field of Classification Search ..... 378/119, 378/121, 122, 138, 140, 143
See application file for complete search history.

(56) References Cited

U.S. PATENT DOCUMENTS

| | | | |
|---|---|---|---|
| 5,077,771 | A | 12/1991 | Skillicorn et al. |
| 5,563,923 | A | 10/1996 | Okada et al. |
| 6,229,876 | B1 | 5/2001 | Enck et al. |
| 6,381,305 | B1 | 4/2002 | Okada et al. |

FOREIGN PATENT DOCUMENTS

| | | |
|---|---|---|
| JP | S39-12336 | 5/1964 |
| JP | S52-20171 | 2/1977 |

*Primary Examiner*—Jurie Yun
(74) *Attorney, Agent, or Firm*—Drinker Biddle & Reath LLP

(57) ABSTRACT

The present invention relates to an X-ray tube in which X-rays are generated by making electrons from an electron gun incident onto an X-ray target of an anode, disposed inside an anode housing unit, and the generated X-rays are taken out from an X-ray emission window. The anode has a straight main body and a protruding portion, extending along an axis line direction of the main body from a tip of the main body. An inclined surface, onto which the electrons emitted from the electron gun collide, and a pair of side surfaces, disposed in parallel while sandwiching the inclined surface, are formed on the protruding portion. A distance between the pair of side surfaces of the protruding portion is shorter than a width of the main body in the same direction as the distance.

9 Claims, 23 Drawing Sheets

(a)

(b)

X-RAY TUBE AND X-RAY SOURCE INCLUDING SAME

TECHNICAL FIELD

The present invention relates to an X-ray tube taking out X-rays, generated within a container, from an X-ray emission window to an exterior, and an X-ray source including the X-ray tube.

BACKGROUND ART

X-rays are electromagnetic waves that are highly transmitted through objects and are frequently used for nondestructive, noncontact observation of internal structures of objects. Normally with an X-ray tube, X-rays are generated by making electrons, emitted from an electron gun, incident on an X-ray target. As described in Patent Document 1, with an X-ray tube, a tubular member, housing an electron gun, is mounted onto a housing member that houses an anode having an X-ray target. Electrons, emitted from the electron gun, are made incident on the X-ray target and X-rays are generated from the X-ray target. The X-rays are transmitted through an X-ray emission window of the X-ray tube and irradiated onto a sample disposed at an exterior. The X-rays transmitted through the sample are captured as a magnified transmission image by any of various X-ray imaging means.

Patent Document 1: U.S. Pat. No. 5,077,771

DISCLOSURE OF THE INVENTION

Problems that the Invention is to Solve

The present inventors have examined the conventional X-ray tubes, and as a result, have discovered the following problems. That is, ovalization of a shape of an X-ray generation region as viewed from the X-ray emission window (hereinafter referred to as the "X-ray generation shape") can be cited as a cause of the captured magnified transmission image becoming unclear. The X-ray generation shape is due to a cross-sectional shape of an electron beam at a point of incidence of electrons onto the X-ray target (hereinafter referred to as the "electron incidence shape"). That is, the closer the electron incidence shape is to being circular, the closer the X-ray generation shape is to being circular. Thus with the X-ray tube described in Patent Document 1, a shield (hood electrode) is disposed at a tip of the anode, including the X-ray target, and the hood electrode is made to have a function of adjusting the electron incidence shape to make the X-ray generation shape as circular as possible.

On the other hand, in order to increase a magnification factor of the captured magnified transmission image, a distance (FOD: Focus Object Distance), from a position of incidence of electrons onto the X-ray target (focal point position of X-rays) to the X-ray emission window, must be made short. However, when the hood electrode is disposed at the tip of the anode, the FOD becomes long. Thus, in the conventional X-ray tube, there was an issue that whereas if the hood electrode is not provided, an adequate definition of the magnified transmission image cannot be obtained, if the hood electrode is provided, increase of the magnification factor of the magnified transmission image is difficult.

The present invention has been developed to eliminate the problems described above. It is an object of the present invention to provide an X-ray tube that has a structure enabling capturing of a clear magnified transmission image and enabling increase of a magnification factor of the magnified transmission image, and an X-ray source including the X-ray tube.

Means for Solving the Problems

An X-ray tube according to the present invention comprises an anode housing unit, an anode having an X-ray target, and an electron gun. The anode housing unit has an X-ray emission window for taking out X-rays generated in an internal portion. The anode is fixed to a predetermined position inside the anode housing unit. The electron gun emits electrons toward the X-ray target to generate X-rays in a direction from the X-ray target toward the X-ray emission window. In particular, the anode has a straight main body and a protruding portion, extending in an axis direction of the main body from a tip of the main body. The protruding portion has an inclined surface, intersecting the axis line at a predetermined angle and matching an electron incidence surface of the X-ray target, and a pair of side surfaces, extending in the same direction as the axis line and disposed parallel across the inclined surface. A distance between the pair of side surfaces of the protruding portion is shorter than a width of the main body in the same direction as the distance.

As described above, the X-ray tube according to the present invention has a structure that satisfies several conditions. Namely, as a first condition, the anode portion is constituted of the main body and the protruding portion. As a second condition, the protruding portion has the inclined surface, matching the electron incidence surface of the X-ray target, on which the electrons emitted from the electron gun are made incident, and the pair of side surfaces, extending in the same direction as the axis line of the main body of the anode and disposed parallel across the inclined surface. As a third condition, the distance between the pair of side surfaces of the protruding portion is less than the width of the main body in the same direction as the distance. By meeting these conditions, an electron incidence shape can be made closer to being circular and an X-ray generation shape can be made closer to being circular. A clear magnified transmission image can thus be obtained. Furthermore, because unlike the conventional X-ray tube, the use of a hood electrode is not required, an FOD can be made short and consequently, a magnification factor of the magnified transmission image can be increased.

In the X-ray tube according to the present invention, a cross section of the protruding portion, orthogonal to the axis line of the main body, preferably has a shape with which a lateral dimension in a direction orthogonal to the pair of side surfaces is shorter than a longitudinal dimension in a direction orthogonal to the lateral dimension. In this case, the electron incidence shape can be made even closer to being circular.

Also, in the X-ray tube according to the present invention, a part of a surface of the protruding portion, positioned at an anode tip, is preferably formed flush to a surface of the main body. In this case, disruption of electric field and occurrence of discharge are less likely to occur as compared with a case where an entirety of the protruding portion surface is made continuous with the main body in a step-like form. As a result, high operation stability without influences of discharge can be obtained.

In the X-ray tube according to the present invention, it is preferable that the anode housing unit has a pair of conductive flat portions disposed parallel to the pair of side surfaces and so as to oppose each other while sandwiching the protruding portion. By actions of the pair of conductive flat portions, the electron incidence shape can be made even closer to being circular.

In the X-ray tube according to the present invention, it is preferable that the electron gun has a circular electron emission exit on a surface facing the X-ray target. In this case, the electron incidence shape can be made even closer to being circular.

Furthermore, an X-ray source according to the present invention includes: the X-ray tube with the above-described structure (X-ray tube according to the present invention); and a power supply unit, supplying a voltage, for generating X-rays at the X-ray target, to the anode at which the X-ray target is disposed.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

EFFECTS OF THE INVENTION

In accordance with the X-ray tube according to the present invention, capturing of a clear magnified transmission image and increase of a magnification factor of the magnified transmission image are enabled.

DESCRIPTION OF THE REFERENCE NUMERALS

Figure 1:
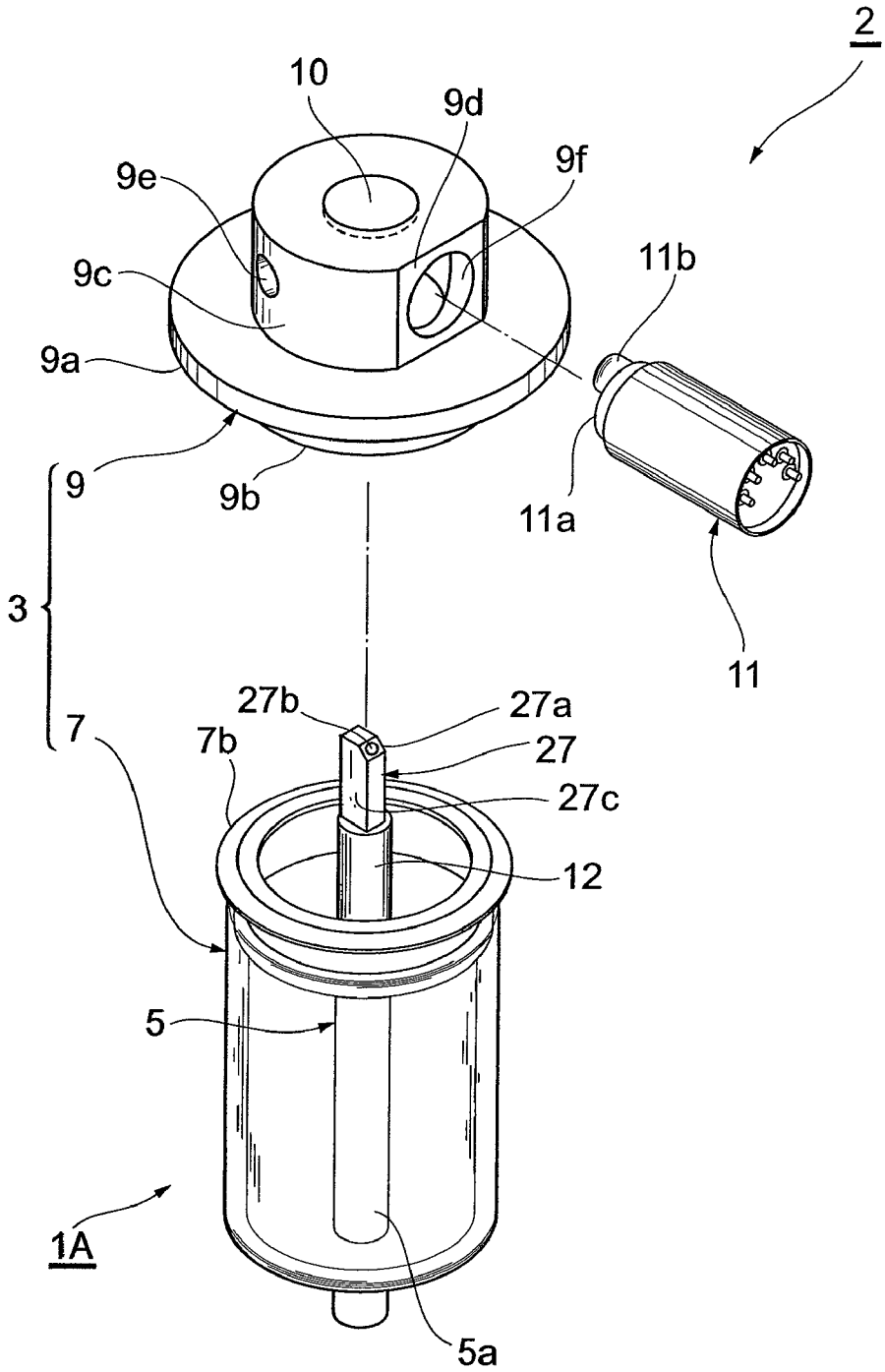
FIG. 1 is an exploded perspective view of an arrangement of a first embodiment of an X-ray tube according to the present invention.

1A, 1B, 1C . . . X-ray tube; 3 . . . vacuum enclosure main body (anode housing unit); 5, 50 . . . anode; 10 . . . X-ray emission window; 12, 51 . . . main body; 13*d* . . . conductive flat portion; 15 . . . electron gun; 15*a* . . . electron emission exit; 27, 52 . . . protruding portion; 27*a*, 52*b* . . . inclined surface; 27*b*, 52*c* . . . target; 27*c*, 52*d* . . . side surface; 27*d*, 52*a* . . . curved surface (portion of surface of protruding portion); C2, C5 . . . axis line of main body; W1 . . . width (distance) between pair of side surfaces; W2 . . . width of main body; M1 . . . lateral dimension; M2 . . . longitudinal dimension; 100 . . . X-ray source; 102 . . . power supply unit; 102A . . . insulating block; 102B . . . high voltage generating unit; 102C . . . high voltage line; 102D . . . socket; 103 . . . first plate member; 103A . . . screw insertion hole; 104 . . . second plate member; 104A . . . screw insertion hole; 105 . . . fastening spacer member; 105A . . . screw hole; 106 . . . metal tubular member; 106A . . . mounting flange; 106B . . . relief surface; 106C . . . insertion hole; 108 . . . conductive coating; 109 . . . fastening screw; 110 . . . high voltage insulation oil; XC . . . X-ray camera; SP sample plate; P . . . observation point; and XP . . . X-ray generation point.

BEST MODES FOR CARRYING OUT THE INVENTION

In the following, embodiments of an X-ray tube and an X-ray source, including the X-ray tube, according to the present invention will be explained in detail with reference to FIGS. 1 to 16. FIGS. 17 to 20 will also be used as suitable to facilitate comparison with a conventional X-ray tube. In the description of the drawings, identical or corresponding components are designated by the same reference numerals, and overlapping description is omitted.

First Embodiment

Figure 2:
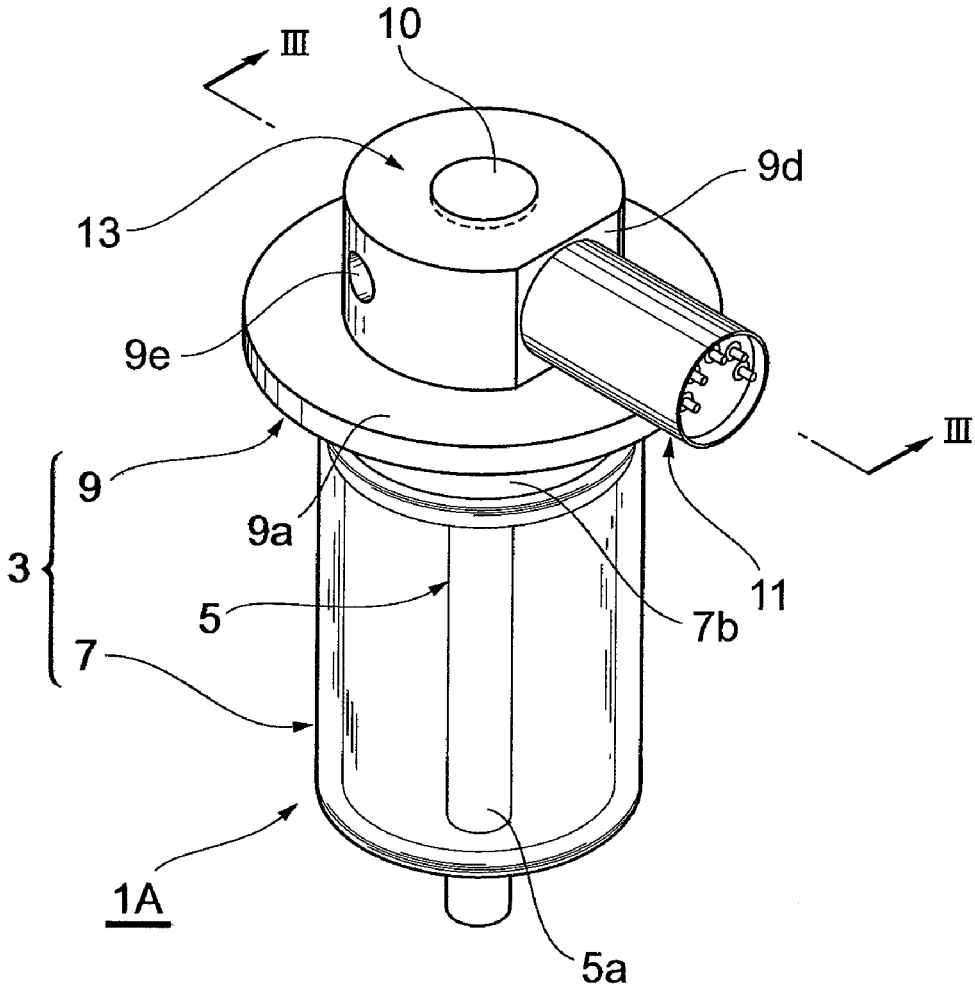
FIG. 2 is a perspective view of an overall arrangement of the X-ray tube according to the first embodiment.
Figure 3:
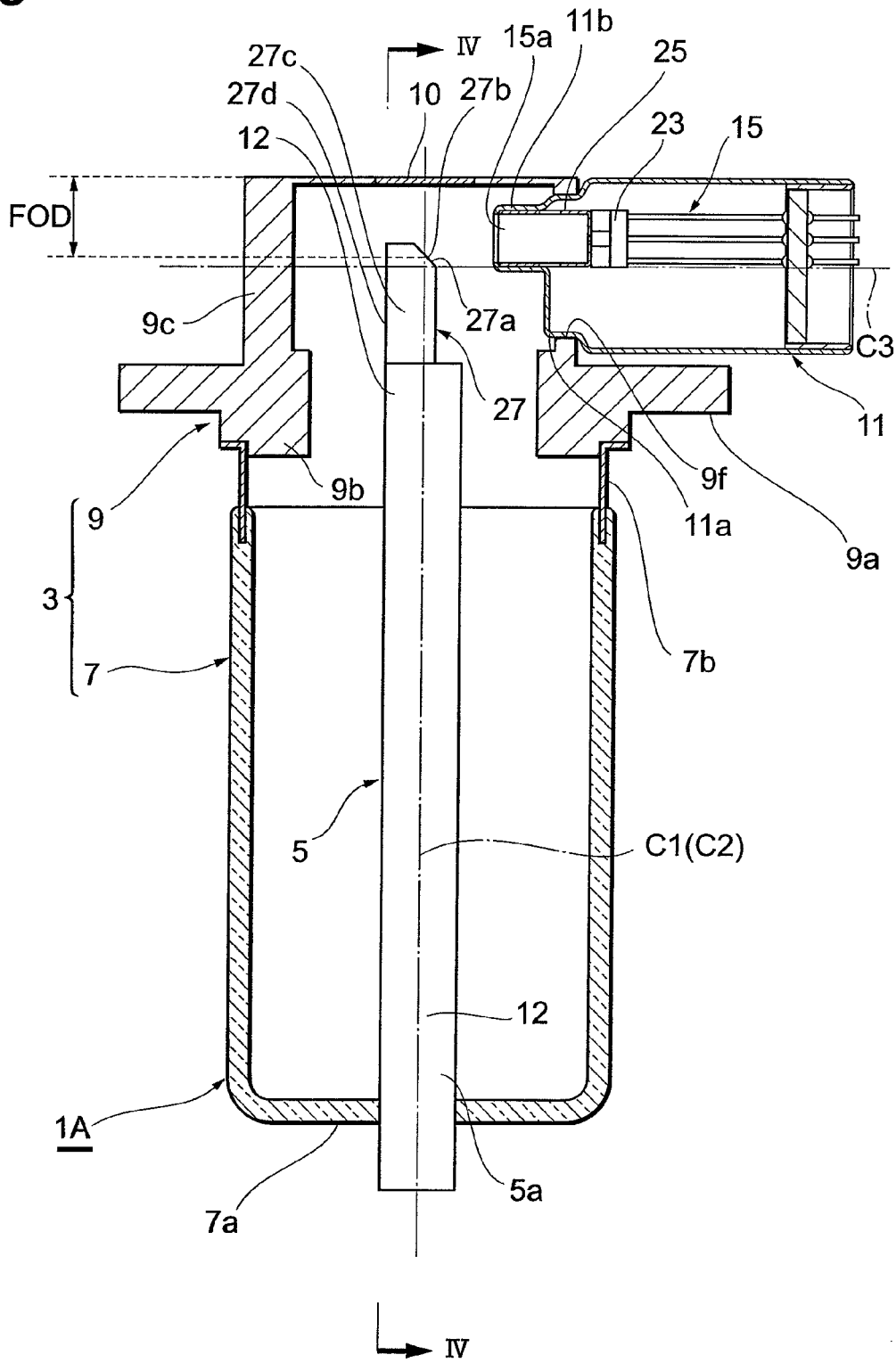
FIG. 3 is a sectional view of an internal structure of the X-ray tube according to the first embodiment taken on line III-III in FIG. 2.
Figure 4:
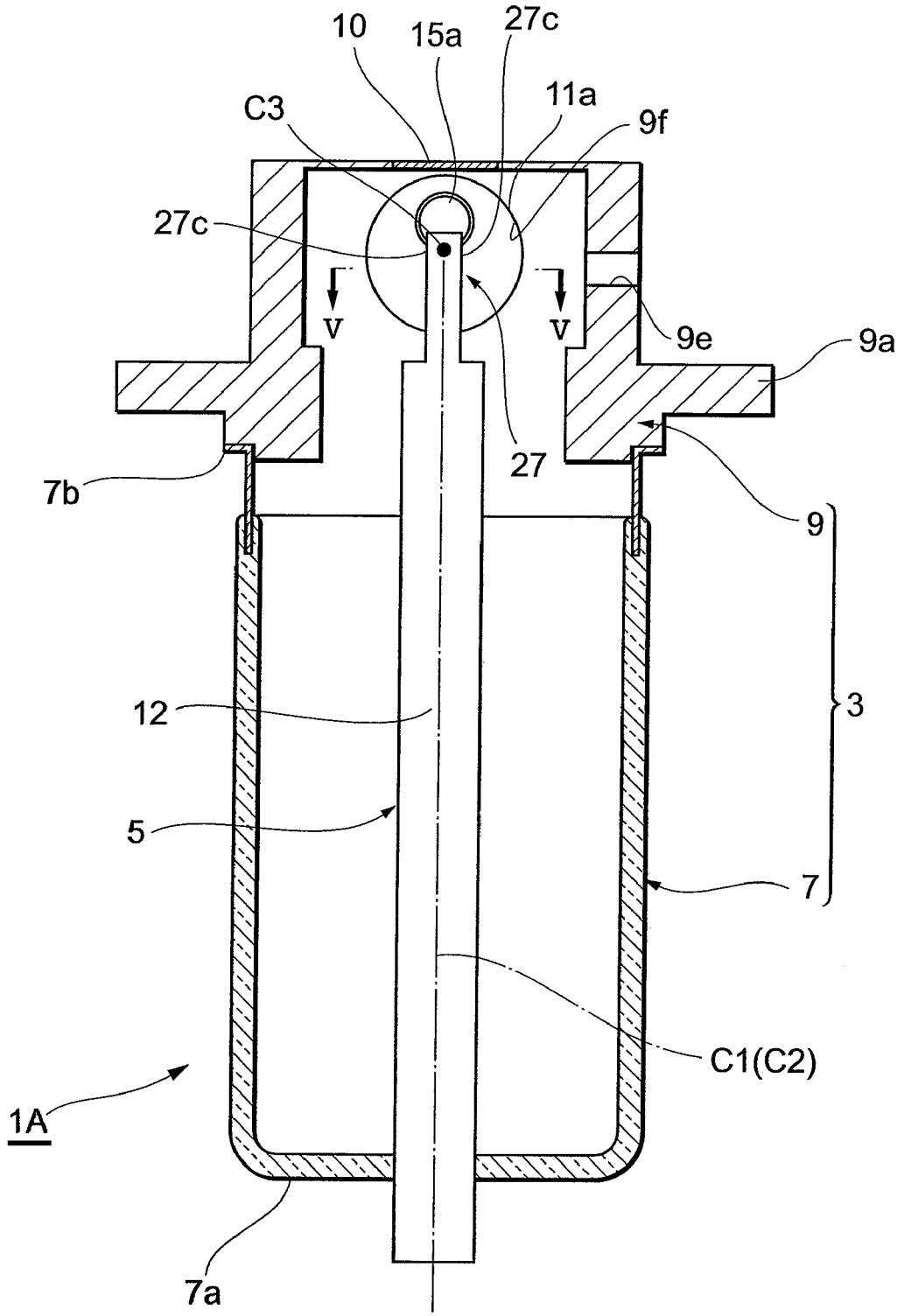
FIG. 4 is a sectional view of an internal structure of the X-ray tube according to the first embodiment taken on line IV-IV in FIG. 3.
Figure 5:
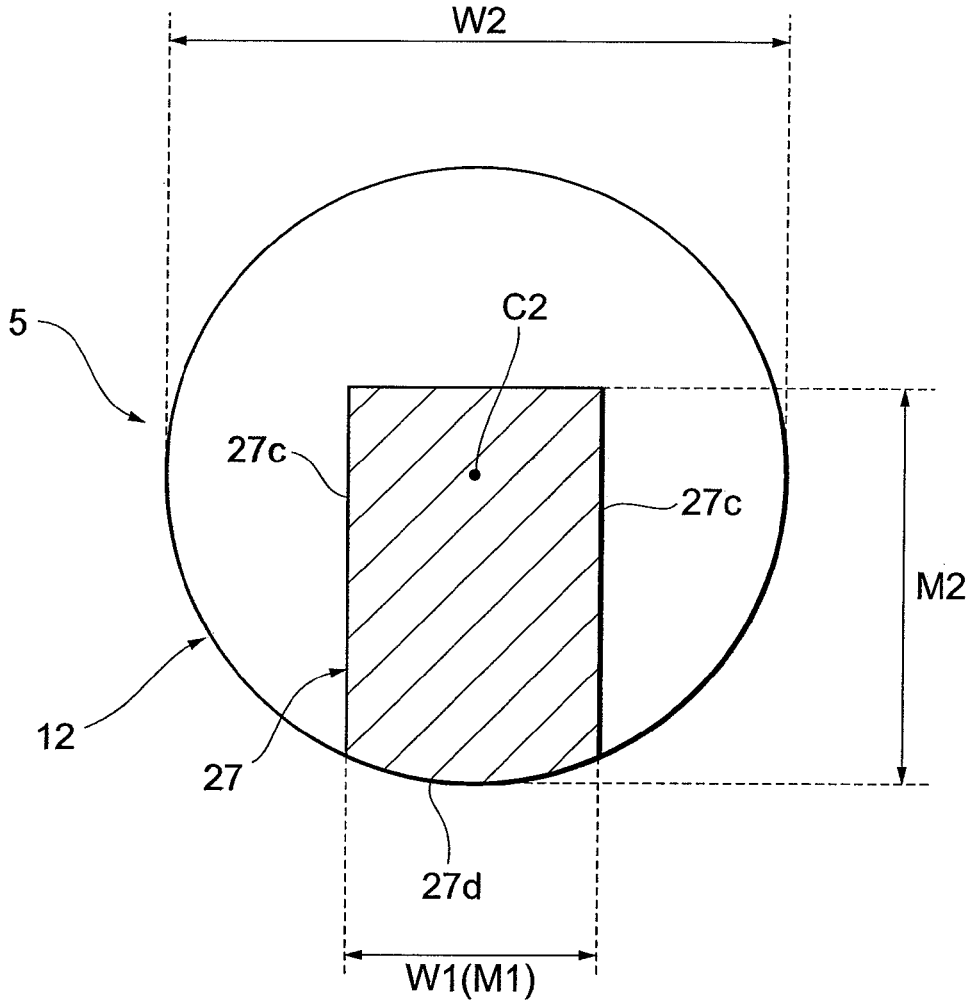
FIG. 5 is a sectional view of an internal structure of the X-ray tube according to the first embodiment taken on line V-V in FIG. 4.
Figure 6:
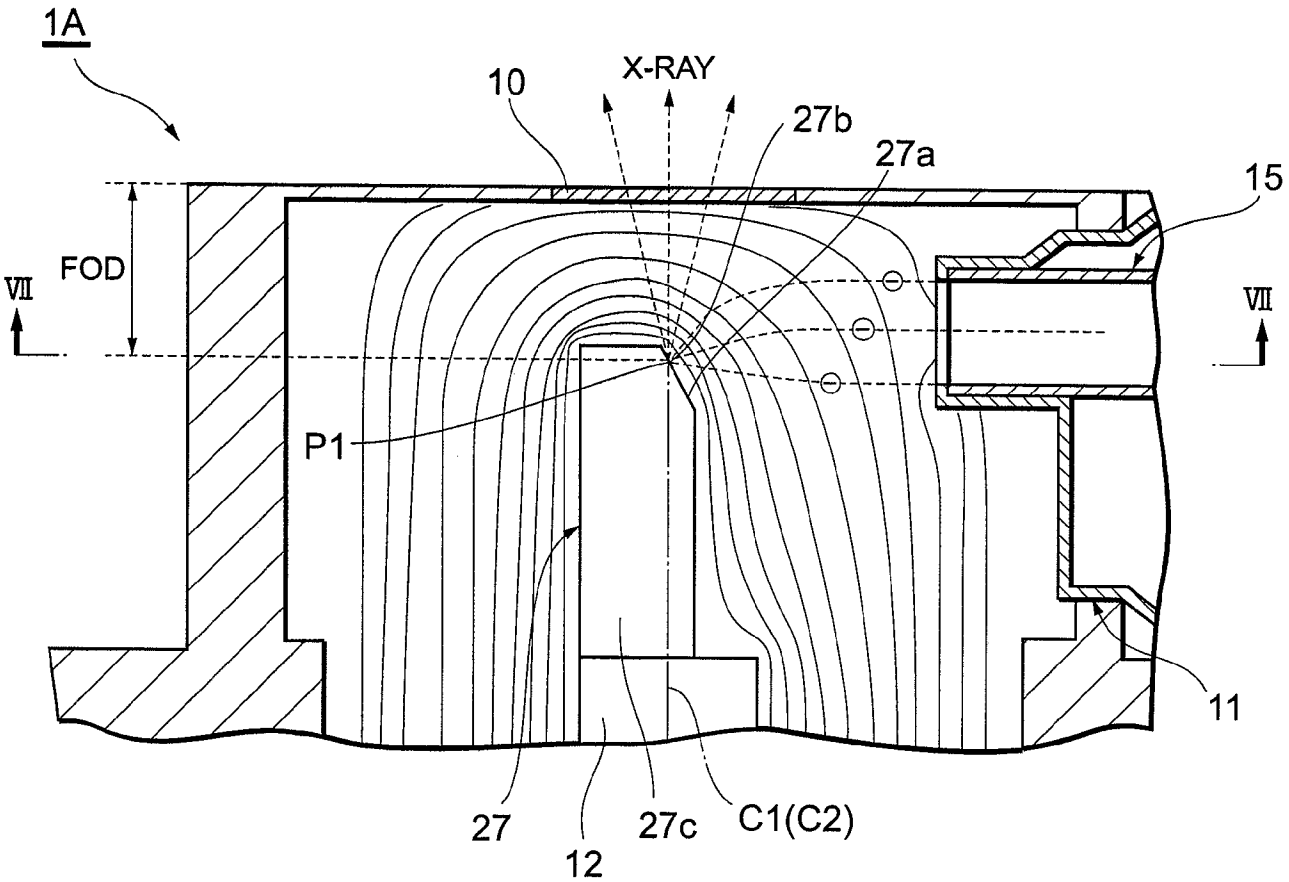
FIG. 6 is an enlarged sectional view for describing equipotential surfaces formed in a periphery of a protruding portion in the X-ray tube according to the first embodiment.
Figure 7:
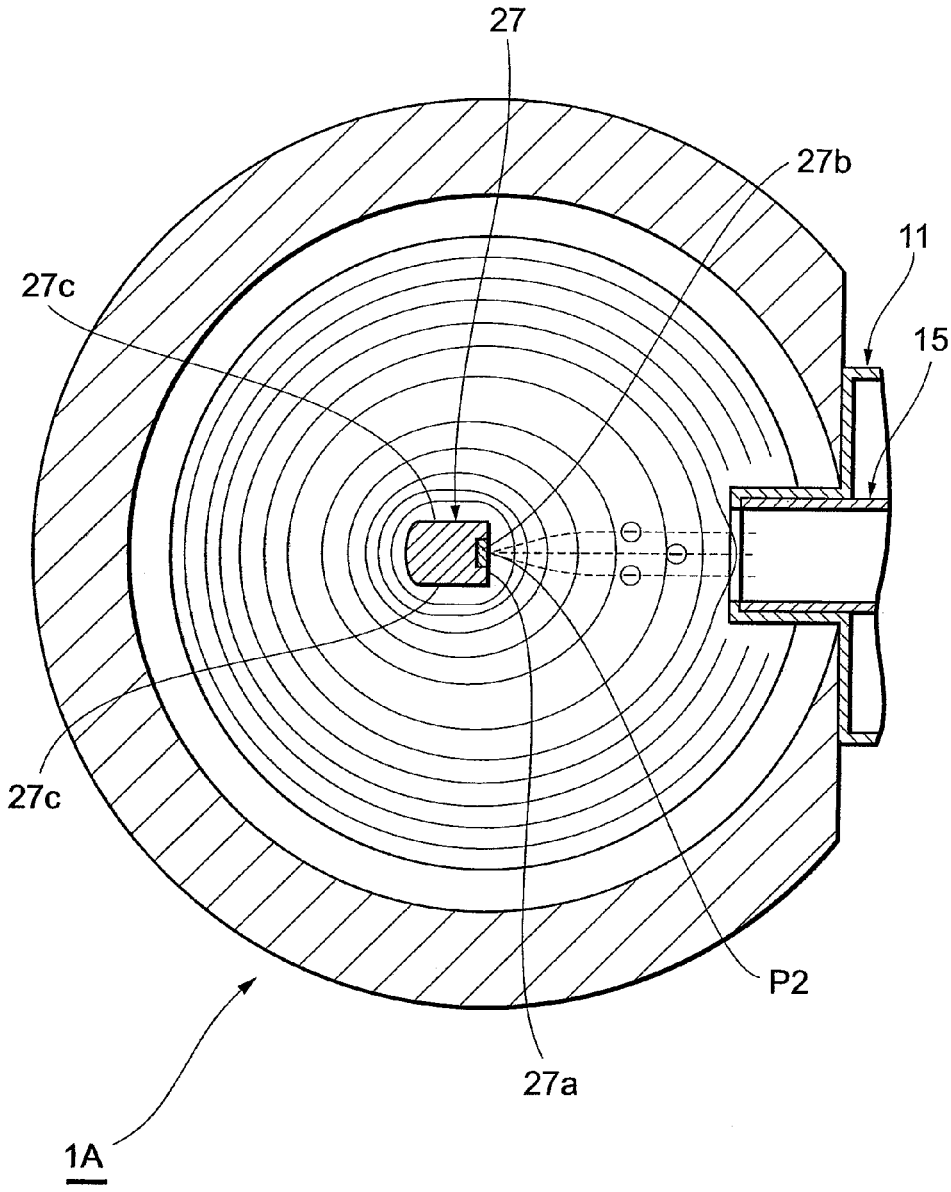
FIG. 7 is a sectional view of the X-ray tube according to the first embodiment taken on line VII-VII in FIG. 6.
Figure 8:
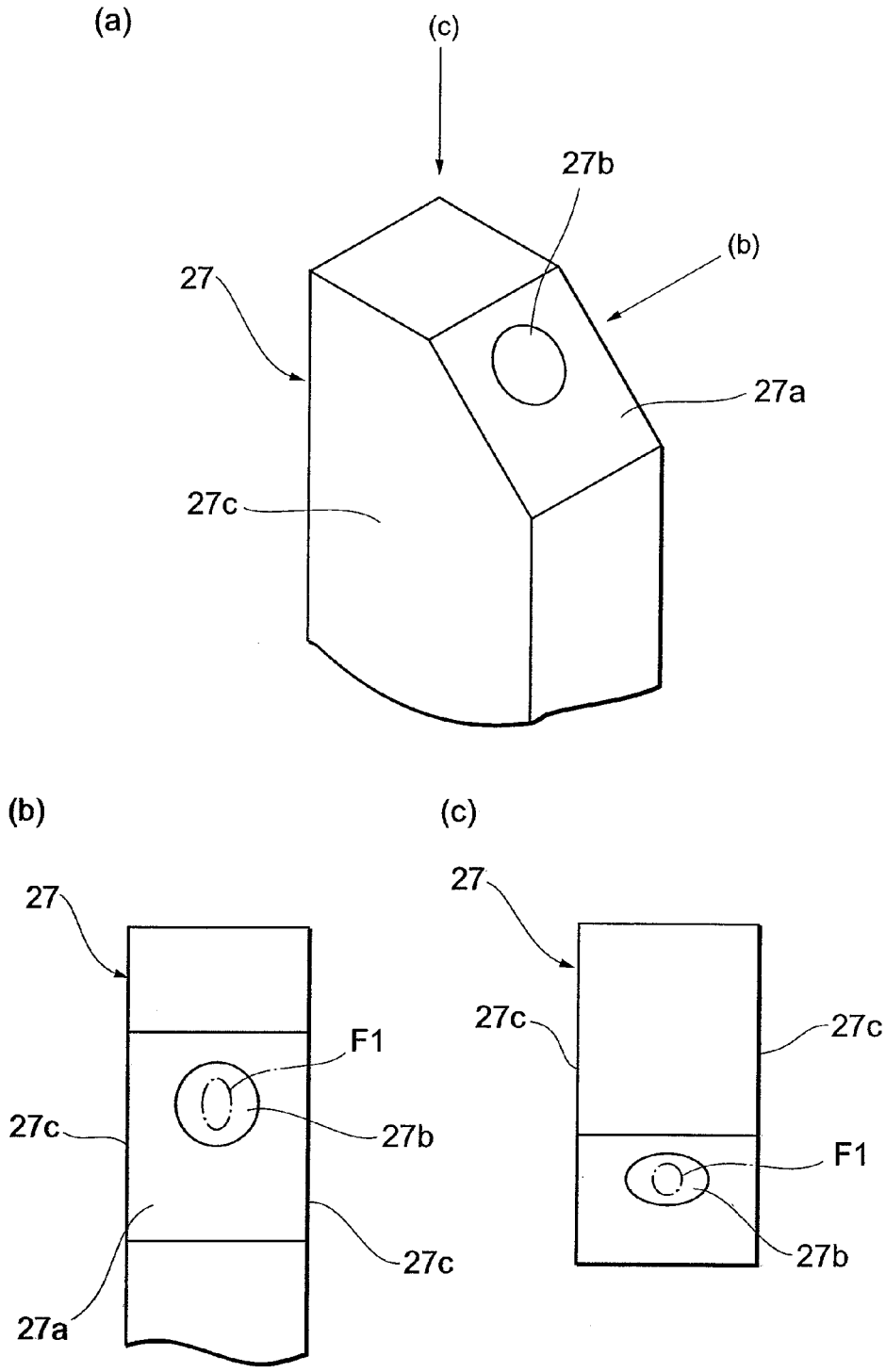
FIG. 8 shows enlarged perspective views of an arrangement of the protruding portion of an anode.
Figure 9:
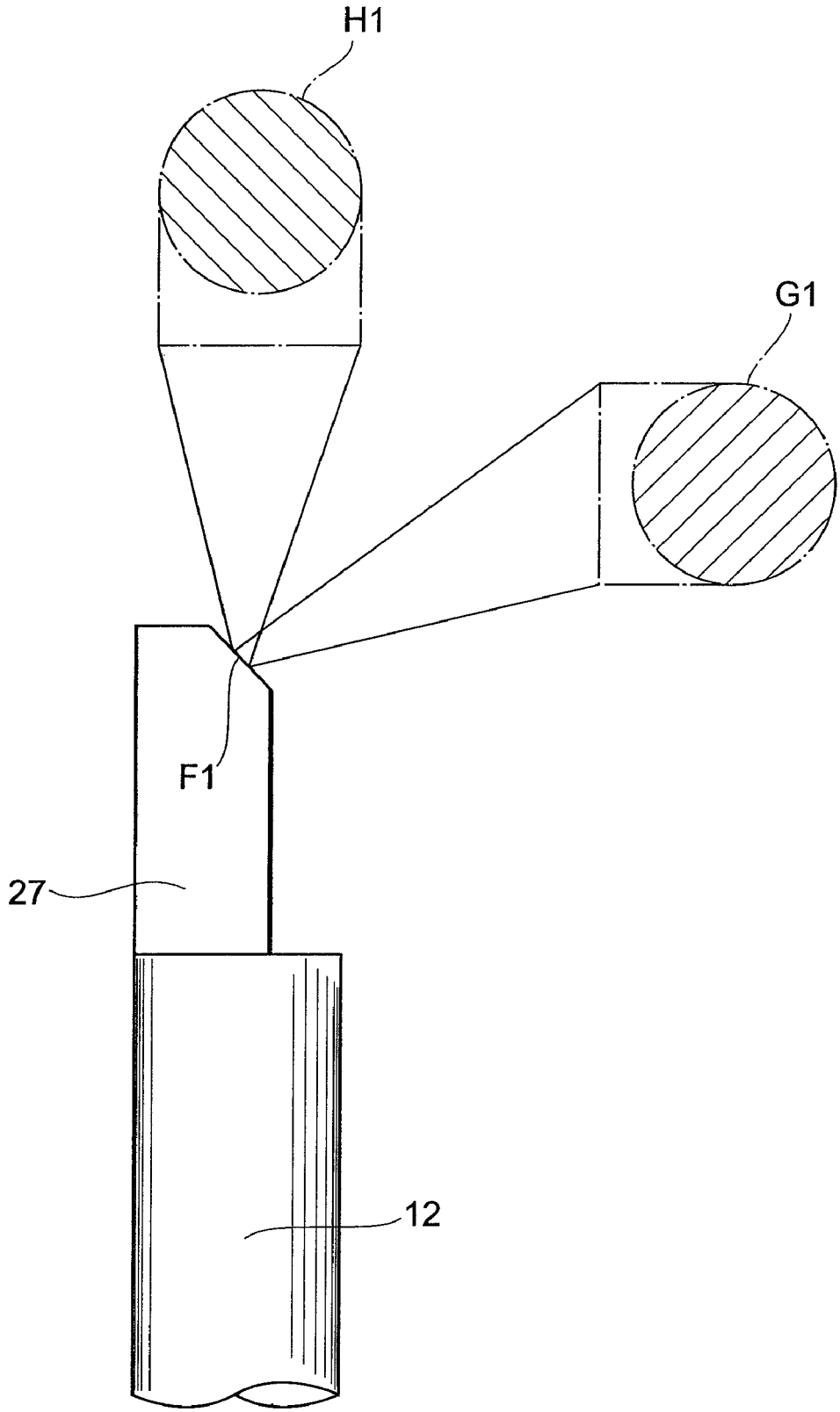
FIG. 9 is a view for explaining an electron incidence shape and an X-ray generation shape at the protruding portion of the anode.

First, an X-ray tube 1A according to a first embodiment will be explained with reference to FIGS. 1 to 9. FIG. 1 is an exploded perspective view of an arrangement of the first embodiment of the X-ray tube according to the present invention. FIG. 2 is a perspective view of an overall arrangement of the X-ray tube 1A according to the first embodiment. FIG. 3 is a sectional view of an internal structure of the X-ray tube 1A according to the first embodiment taken on line III-III in FIG. 2. FIG. 4 is a sectional view of an internal structure of the X-ray tube 1A according to the first embodiment taken on line IV-IV in FIG. 3. FIG. 5 is a sectional view of an internal structure of the X-ray tube 1A according to the first embodiment taken on line V-V in FIG. 4. FIG. 6 is an enlarged sectional view for describing equipotential surfaces formed in a periphery of a protruding portion in the X-ray tube 1A according to the first embodiment. FIG. 7 is a sectional view of the X-ray tube 1A according to the first embodiment taken on line VII-VII in FIG. 6. FIG. 8 shows enlarged perspective views of an arrangement of the protruding portion of an anode. FIG. 9 is a view for explaining an electron incidence shape and an X-ray generation shape at the protruding portion of the anode. In particular, in FIG. 8, the area (a) is an enlarged perspective view of the protruding portion 27 of the anode 5, the area (b) is a perspective view of the protruding portion 27 as viewed in a direction of arrow (b) in the area (a), and the area (c) is a perspective view of the protruding portion 27 as viewed in a direction of arrow (b) in the area (a).

As shown in FIGS. 1 to 4, the X-ray tube 1A according to the first embodiment is a sealed X-ray tube. The X-ray tube 1A has a tubular vacuum enclosure main body 3 as an anode housing unit, and the anode 5, having a target 27*b* to be described below, is housed in the vacuum enclosure main body 3. The vacuum enclosure main body 3 is constituted of a substantially cylindrical bulb 7, supporting the anode 5, a substantially cylindrical head 9, having an X-ray emission window 10, and a ring member 7*b*, connecting the bulb 7 and the head 9, and a vacuum enclosure 2 is obtained by welding an electron gun housing unit 11 to the vacuum enclosure main body 3. An interior of the vacuum enclosure 2 is decompressed to a predetermined degree of vacuum. The bulb 7 and the head 9 are fixed to the ring member 7*b* so as to have a tube axis line C1 in common. The X-ray emission window 10 is disposed at one end of the head 9 in the tube axis line C1 direction. On the other hand, the other end in the tube axis line C1 direction of the bulb 7, comprised of glass (insulator), has a shape that decreases in diameter in a form of closing an opening, and the anode 5 is held at a desired position inside the vacuum enclosure main body 3 with a part of a base end 5*a* of the anode 5 being exposed to an exterior. The vacuum enclosure main body 3 thus has the X-ray emission window 10 at one end thereof and holds the anode 5 at the other end thereof. In the description that follows, upper and lower sides are defined so that one end side (the X-ray emission window 10 side) in the tube axis line C1 direction of the vacuum enclosure main body 3 is the upper side and the other end side (the side at which the anode 5 is held) in the tube axis line C1 direction of the vacuum enclosure main body 3 is the lower side.

The ring member 7*b* is fused to an upper end of the bulb 7. The ring member 7*b* is a cylindrical member comprised of metal and has an annular flange formed at its upper end. The upper end of the ring member 7*b* is welded to a lower end of the head 9 in a state of being put in contact with the lower end.

The head 9 is a metal member with a substantially cylindrical shape, and an annular flange 9*a* is formed on its outer periphery. The head 9 is divided into a lower portion 9*b* and an upper portion 9*c* across the flange portion 9*a*, and the ring member 7*b* is welded to a lower end of the lower portion 9*b* so as to share the tube axis line C1 in common with the bulb 7. The X-ray emission window 10 comprised of a Be material is disposed at the upper portion 9*c* of the head 9 so as to close an opening of an end of the upper portion 9*c*. Furthermore, an exhaust port 9*e* for putting an interior of the vacuum enclosure 2 into a vacuum state is formed in the upper portion 9*c*, and an unillustrated exhaust tube is fixed to the exhaust port 9*e*.

A flat portion 9*d* is formed on an outer periphery of the upper portion 9*c* of the head 9, and a head side through hole 9*f*, for installation of the electron gun housing unit 11, is formed in the flat portion 9*d*.

The electron gun housing unit 11 has a substantially cylindrical shape and at one end thereof is disposed a cylindrical neck 11*a*, which protrudes and is reduced in diameter, and a cylindrical portion 11*b* protrudes from the neck 11*a*. By the neck 11*a* being fitted into the head side through hole 9*f* of the head 9, the electron gun housing unit 11 is positioned in the head 9 in a manner such that a tube axis line C3 of the electron gun housing unit 11 is substantially orthogonal to the tube axis line C1 of the vacuum enclosure main body 3. The electron gun housing unit 11 is joined to the head 9.

As shown in FIG. 3, the electron gun 15 is housed inside the electron gun housing unit 11. The electron gun 15 includes an electron generating unit 23 and a focusing electrode 25. The focusing electrode 25 has a cylindrical shape, and a tip of the focusing electrode 25 is fitted in an inner peripheral surface of the cylindrical portion 11*b* of the electron gun housing unit 11. The focusing electrode 25 is thereby positioned in the electron gun housing unit 11. An opening at the tip of the focusing electrode 25 and an opening of the cylindrical portion 11*b* are formed to be circular and function as an electron emission exit 15*a*.

When electrons are emitted from the electron generating unit 23, the electrons are subject to a focusing action by the focusing electrode 25. X-rays are generated by incidence of the emitted electrons onto the target 27*b*, to be described below, via the electron emission exit 15*a*.

As shown in FIGS. 1, 3, and 4, the bulb 7 and the head 9 are positioned to have the tube axis line C1 in common. The anode 5 has a main body 12 that extends straight along the tube axis line C1. A base end of the main body 12 is held in another end 7*a* of the bulb 7. The anode 5 has formed thereon the protruding portion 27 that extends along an axis line C2 direction from a tip of the main body 12 toward the X-ray emission window 10 side. The protruding portion 27 has a cross section of substantially rectangular shape and is disposed inside the head 9. A tip of the protruding portion 27 is notched in an inclined manner and thereby formed to an inclined surface 27*a*. In the inclined surface 27*a*, the disk-like target 27*b* is embedded so that an electron incidence surface thereof is substantially parallel to the inclined surface 27*a* (see FIG. 1). The target 27*b* is comprised of tungsten, and besides the target 27*b*, the anode 5 is comprised, for example, of copper. X-rays are generated when the electrons emitted from the electron gun 15 are made incident on the target 27*b*. The inclined surface 27*a* is inclined to an orientation of facing the electron gun 15 and by just a predetermined angle with respect to the axis line C2 of the main body 12 to enable the X-rays to be taken out from the X-ray emission window 10 positioned along the axis line C2.

The protruding portion 27 has a pair of side surfaces 27*c*, extending in the same direction as the axis line C2 of the main body 12 and disposed in parallel while sandwiching the inclined surface 27*a*. As shown in FIG. 5, a width W1 between the pair of side surfaces 27*c* is made smaller than a width W2 of the main body 12 in the same direction as the width W1.

At the protruding portion 27, a surface 27*d* at a side opposite a side facing the electron gun 15 is formed as a curved surface that is flush with a surface of the main body 12. By providing the curved surface 27*d* that is flush to the surface of the main body 12, a step portion between the protruding portion 27 and the main body 12 can be minimized. Thus, as compared with a case where there are no surfaces at all that are flush, discharge is less likely to occur and a high operation stability can be achieved.

As shown in FIGS. 3 and 4, the protruding portion 27 extends in the direction of the axis line C2 of the main body 12 from the tip of the main body 12. Thus, as compared with a shape, with which a target is bent, discharge is less likely to occur and a high operation stability can be achieved.

As shown in FIGS. 6 and 7, when a predetermined voltage is applied to respective electrodes inside the head 9, an electric field is formed in a space inside the head 9. The electrons emitted from the electron gun 15 propagate while receiving an influence of the electric field formed in the space inside the head 9 (propagate while receiving a force in directions of normals to the equipotential surfaces), and in a final stage, by incidence of the electrons onto the target 27*b* of the inclined surface 27*a*, X-rays are generated from the target 27*b*. A position of the target 27*b* at which the X-rays are made incident is a focal point position of the X-rays, an FOD is a distance from the focal point position of the X-rays to the X-ray emission window 10, and the shorter the FOD, the more improved a magnification factor of a magnified transmission image.

A description shall now be provided in regard to a size of a focal point of electrons, a focal point shape, and the FOD in the X-ray tube 1A according to the first embodiment by providing a comparison with a conventional X-ray tube (X-ray tube described in Patent Document 1) arrangement, from which the hood electrode has been removed.

Figure 17:
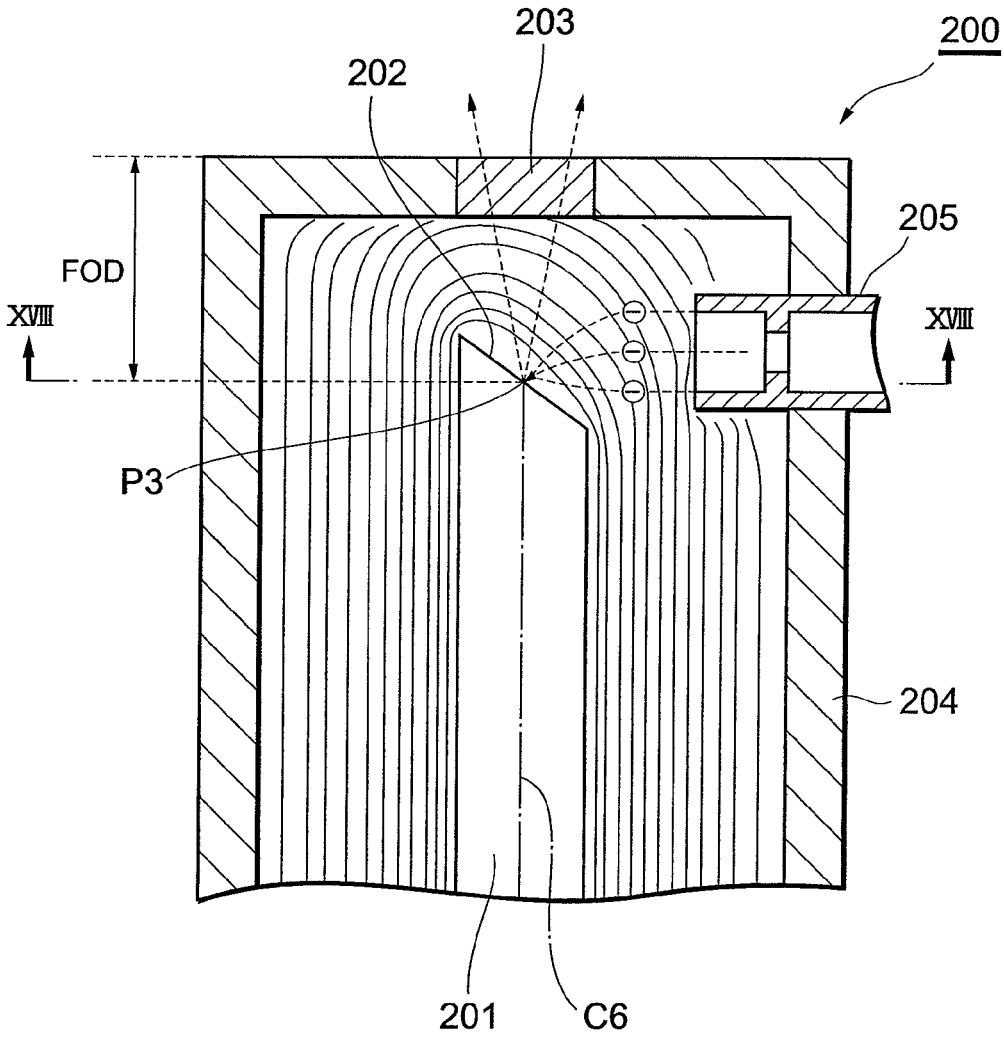
Fig.17 PRIOR ART
FIG. 17 is an enlarged sectional view of a structure in a vicinity of a target in a conventional X-ray tube.
Figure 18:
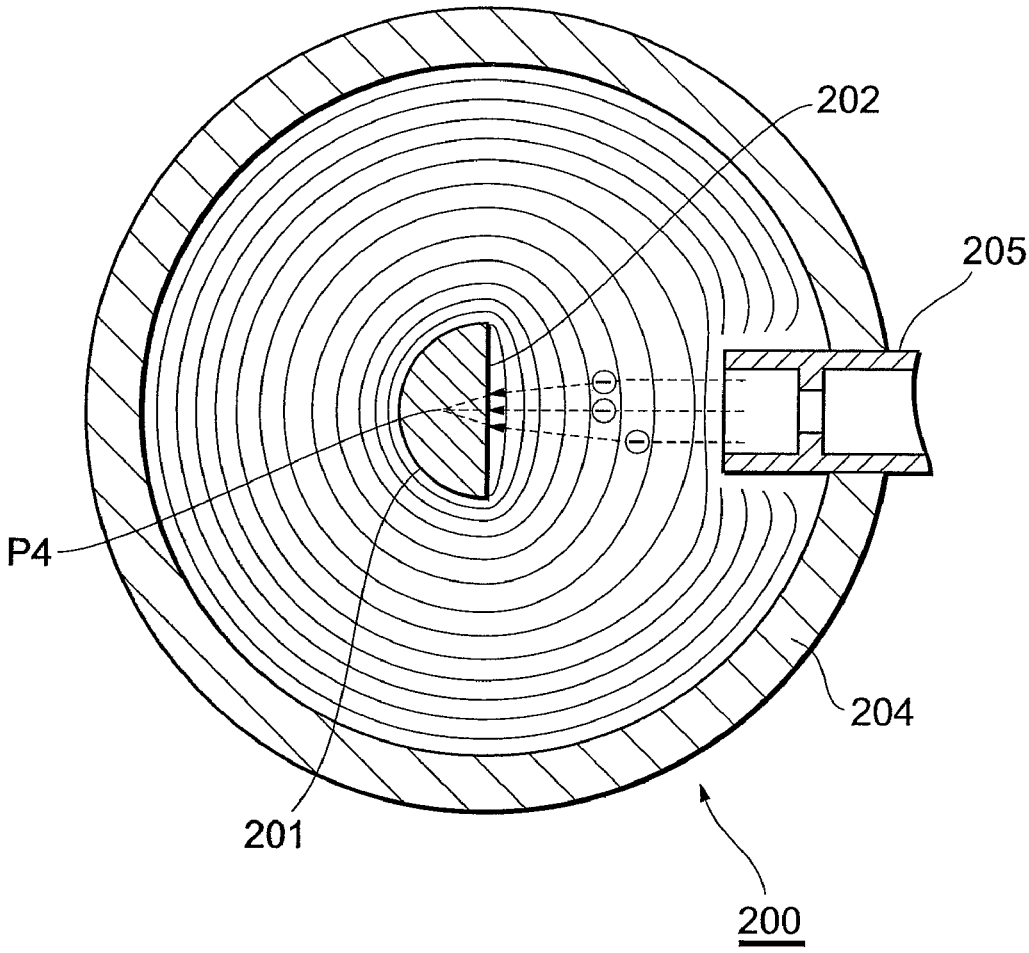
Fig.18 PRIOR ART
FIG. 18 is a sectional view of an internal structure of the conventional X-ray tube taken on line XVIII-XVIII in FIG. 17.
Figure 19:
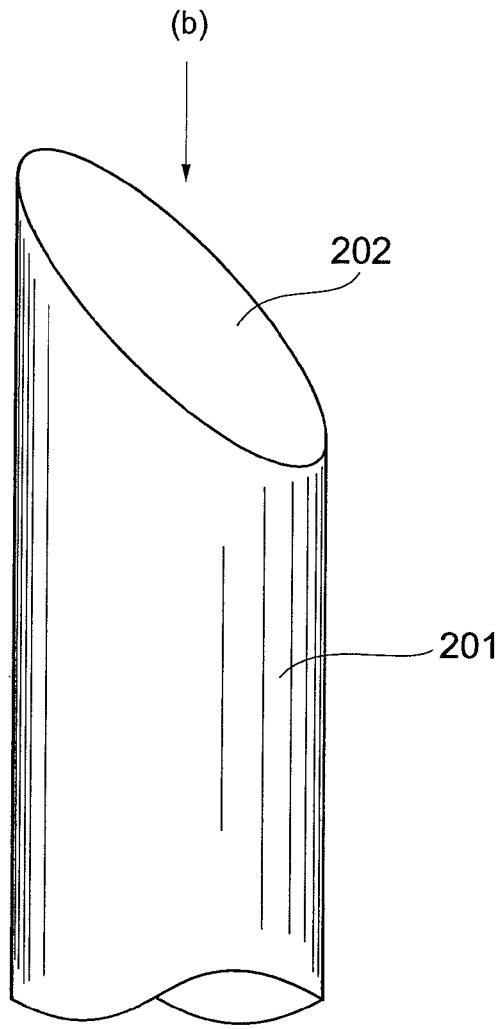
FIG. 19 shows enlarged perspective views of a structure of an anode tip in the conventional X-ray tube.
Figure 19:
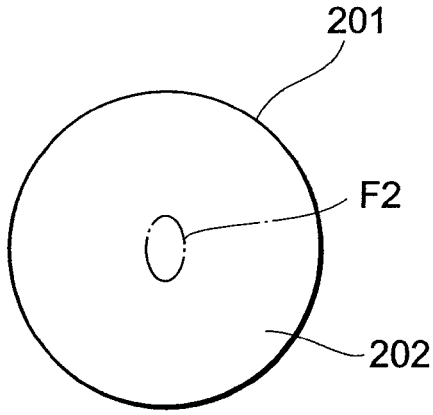
Figure 20:
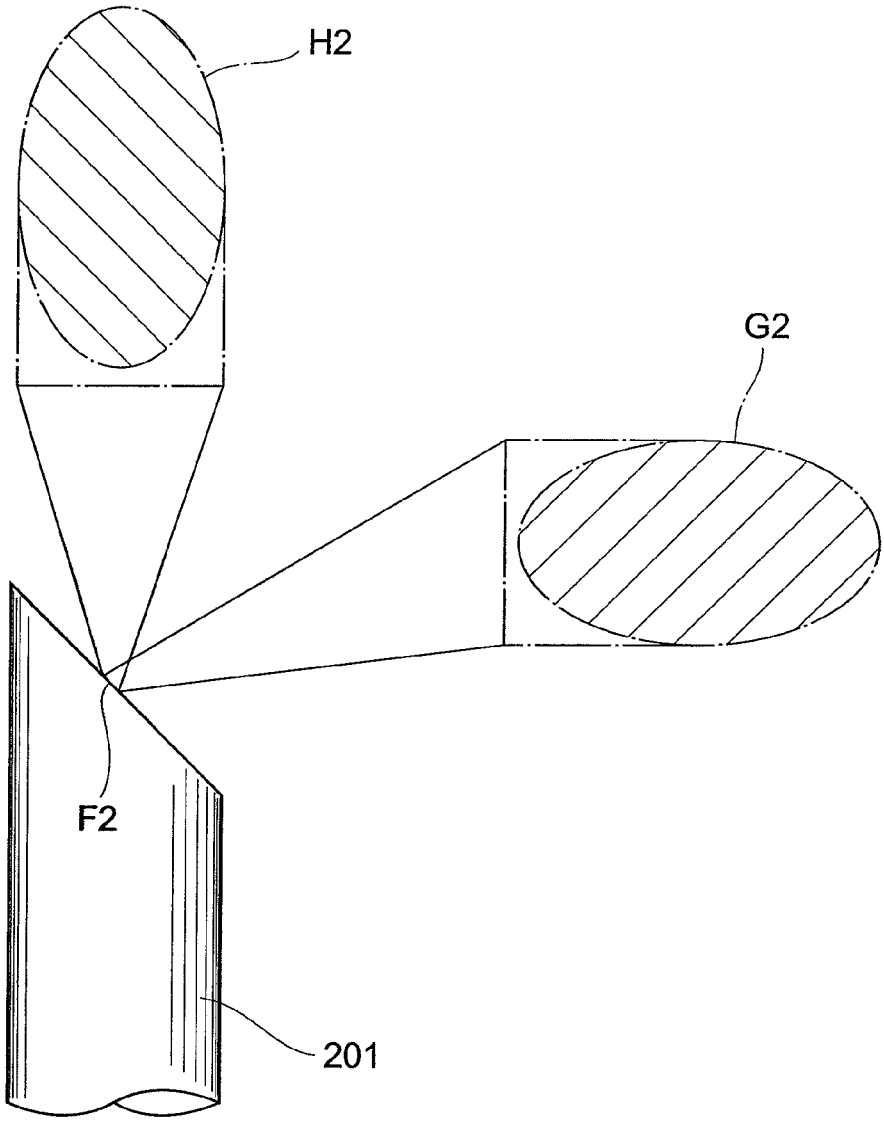
FIG. 20 is a view for explaining an electron incidence shape and an X-ray generation shape at the anode tip in the conventional X-ray tube.

FIGS. 17 to 20 to show an X-ray tube (hereinafter referred to as the "conventional X-ray tube") 200, with which the hood electrode is removed from the conventional X-ray tube. FIG. 17 is an enlarged sectional view of a structure in a vicinity of a target in the conventional X-ray tube 200. FIG. 18 is a sectional view of an internal structure of the conventional X-ray tube 200 taken on line XVIII-XVIII in FIG. 17. FIG. 19 shows enlarged perspective views of a structure of an anode tip in the conventional X-ray tube 200. FIG. 20 is a view for explaining an electron incidence shape and an X-ray generation shape at the anode tip in the conventional X-ray tube 200. In FIG. 19, the area (a) is a perspective view of a target tip, and the area (b) is a perspective view of the target tip as viewed in a direction indicated by arrow (b) in the area (a). The conventional X-ray tube 200 has an inclined surface 202, of a shape formed by notching the tip of a circular anode 201 obliquely, as the target and generates X-rays by making electrons incident on the target.

Here, generally, the closer an electron incidence shape G2 is to being circular, the closer an X-ray generation shape H2 is to being circular as a result. The "electron incidence shape" refers to a cross-sectional shape of an electron beam at a point of incidence of the electrons onto the target, and an "X-ray generation shape" refers to a cross-sectional shape of X-rays when viewed from an X-ray emission window 203. That is, the closer a focal point position P3 (see FIG. 17) of the electron beam along an extension of a propagation path of the electrons emitted from an electron gun 205 and a focal point position P4 (see FIG. 18) of the electron beam along an extension of a propagation path of the electrons emitted from an electron gun 205 become so as to substantially match each other (and especially in a case where microfocusing is sought, the closer these positions become so as to substantially match on the target), the closer the electron incidence shape G2 (see FIG. 20) becomes to being circular and the closer the X-ray generation shape H2 becomes to being circular.

In the conventional X-ray tube 200, the cylindrical anode 201 is disposed along a tube axis line C6 of a cylindrical case 204. The obliquely notched inclined surface 202 is formed at the tip of the anode 201, and the inclined surface 202 is the target. X-rays are generated by the incidence of electrons onto the inclined surface 202. Here, in the conventional X-ray tube 200, because the electron beam focal point position P3 (FIG. 17) and the electron beam focal point position P4 (FIG. 18) differ, the electron incidence shape G2 is elliptical as shown in FIG. 20. As a result, the X-ray generation shape H2 also readily tends to be elliptical.

On the other hand, as shown in FIGS. 5, 6, and 7, in the X-ray tube 1A according to the first embodiment, the protruding portion 27 of the anode 5 extends in the same direction as the axis line C2 of the main body 12, and the pair of side surfaces 27*c*, disposed parallel while sandwiching the inclined surface 27*a*, are formed on the protruding portion 27. Furthermore, the width W1 between the pair of side surfaces 27*c* is less than the width (diameter) W2 of the main body 12 in the same direction as the width W1. Thus unlike the conventional X-ray tube 200, an electron beam focal point position P1 (FIG. 6) and an electron beam focal point position P2 (FIG. 7) can be made substantially equal. Thus as shown in FIG. 9, an electron incidence shape G1 is made closer to being circular, and an X-ray generation shape H1 also tends to be circular readily.

Also, in the conventional X-ray tube 200, because the electron incidence shape G2 is elliptical, an electron incidence region shape F2 on the target becomes a shape that is close to being elliptical as viewed from the X-ray emission window 203 (see FIG. 17) as indicated by an alternate long and short dashes line in FIG. 19. As a result, the X-ray generation shape H2 is also elliptical and the magnified transmission image becomes unclear.

On the other hand, in the X-ray tube 1A according to the first embodiment, because the electron incidence shape G1 is made closer to being circular, an electron incidence region shape F1 on the target can readily be made circular as viewed from the X-ray emission window 10 (see FIG. 6) as indicated in FIG. 8C. By the X-ray generation shape H1 thus being circular, a clear magnified transmission image can be obtained.

In the X-ray tube 1A according to the first embodiment, in a cross section, passing through the protruding portion 27 and orthogonal to the axis line C2 of the main body 12, a lateral dimension M1 in a direction orthogonal to the pair of side surfaces 27*c* is shorter than a longitudinal dimension M2 in a direction orthogonal to the lateral direction M1 as shown in FIG. 5. Thus, as compared with the conventional X-ray tube 200, the electron incidence shape G1 is closer to being circular, and the X-ray generation shape H1 also readily tends to be even more circular.

Also, in the X-ray tube 1A according to the first embodiment, the electron emission exit 15*a*, disposed in the electron gun 15, is formed to be circular as shown in FIG. 4. The electron incidence shape G1 can thus readily be made even more circular.

Second Embodiment

Figure 10:
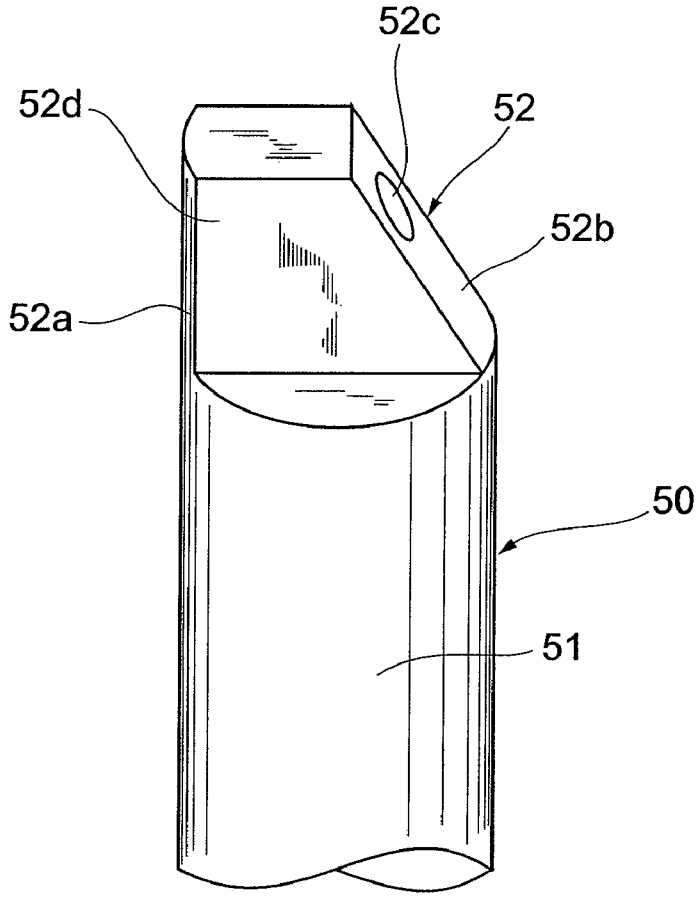
FIG. 10 is an enlarged perspective view, particularly of an arrangement of a protruding portion of an anode portion as a characteristic portion of a second embodiment of an X-ray tube according to the present invention.
Figure 11:
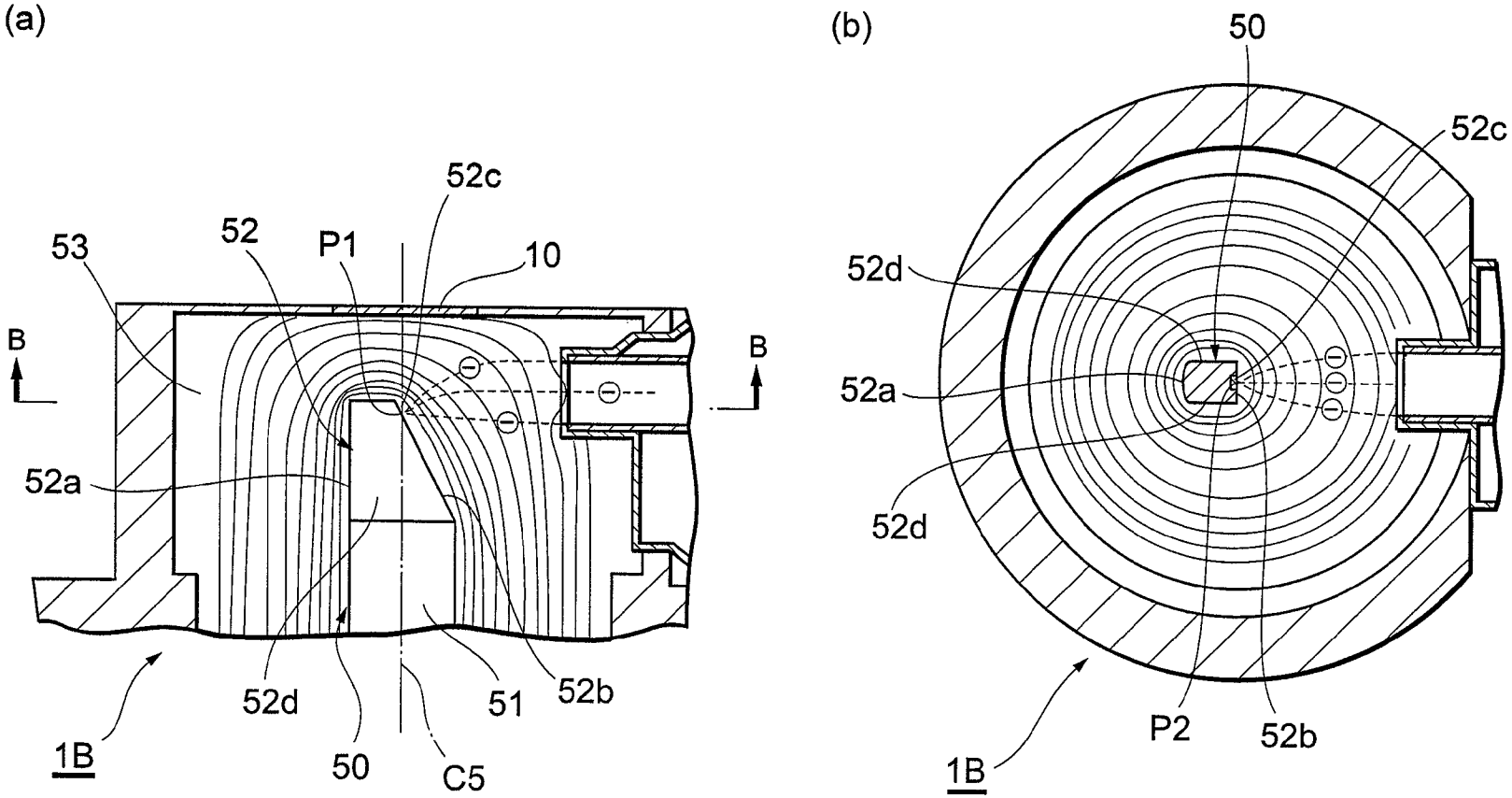
FIG. 11 shows views for explaining equipotential surfaces formed in a periphery of the protruding portion in the X-ray tube according to the second embodiment.

Next, an X-ray tube according to a second embodiment will be explained with reference to FIGS. 10 and 11. FIG. 10 is an enlarged perspective view, particularly of an arrangement of a protruding portion of an anode portion as a characteristic portion of the second embodiment of the X-ray tube according to the present invention. FIG. 11 shows views for explaining equipotential surfaces formed in a periphery of the protruding portion in the X-ray tube according to the second embodiment. In particular in FIG. 11, the area (a) is an enlarged sectional view of a vicinity of the protruding portion, and the area (b) is a sectional view of a vicinity of the protruding portion taken on line B-B of the area (a). In the X-ray tube 1B according to the second embodiment, structures that are the same as or equivalent to those of the X-ray tube 1A according to the first embodiment shall be provided with the same symbol and description thereof shall be omitted.

In the X-ray tube 1B according to the second embodiment, an anode 50 has a main body 51 that is cylindrical and extends straightly. The anode 50 also has a protruding portion 52, extending in an axis line C5 direction of the main body 51 from a tip of the main body 51. The protruding portion 52 has a curved surface 52*a*, formed flush to a surface of the main body 51 and extending straight in the axis line C5 direction. At the protruding portion 52, an inclined surface 52*b*, continuous with the surface of the main body 51, is formed at an opposite side of the curved surface 52*a* across the axis line C5 of the main body 51. The inclined surface 52*b* is inclined by just a predetermined angle with respect to the axis line C5 so that X-rays are taken out from the X-ray emission window 10. A target 52*c* comprised of tungsten is embedded in the inclined surface 52*b*. A pair of side surfaces 52*d*, formed so as to sandwich the inclined surface 52*b*, are disposed parallel. A width between the pair of side surfaces 52*d* is smaller than a width of the main body 51 in the same direction as this width. Furthermore, in a cross section passing through the protruding portion 52 and orthogonal to the axis line C5 of the main body 51, a lateral dimension in a direction orthogonal to the pair of side surfaces 52*d* is shorter than a longitudinal dimension in a direction orthogonal to the lateral direction. This matter is the same as with the anode 5 of the X-ray tube 1A according to the first embodiment.

The X-ray tube 1B according to the second embodiment differs from the X-ray tube 1A according to the first embodiment in that the protruding portion 52 is short. However, similar to the X-ray tube 1A according to the first embodiment, the electron beam focal point positions P1 and P2, shown in the areas (a) and (b) in FIG. 11, respectively, can be made to be matched substantially, as compared with the conventional X-ray tube 100 shown in FIGS. 17 to 19, the X-ray generation shape H1 is made circular readily.

Third Embodiment

Figure 12:
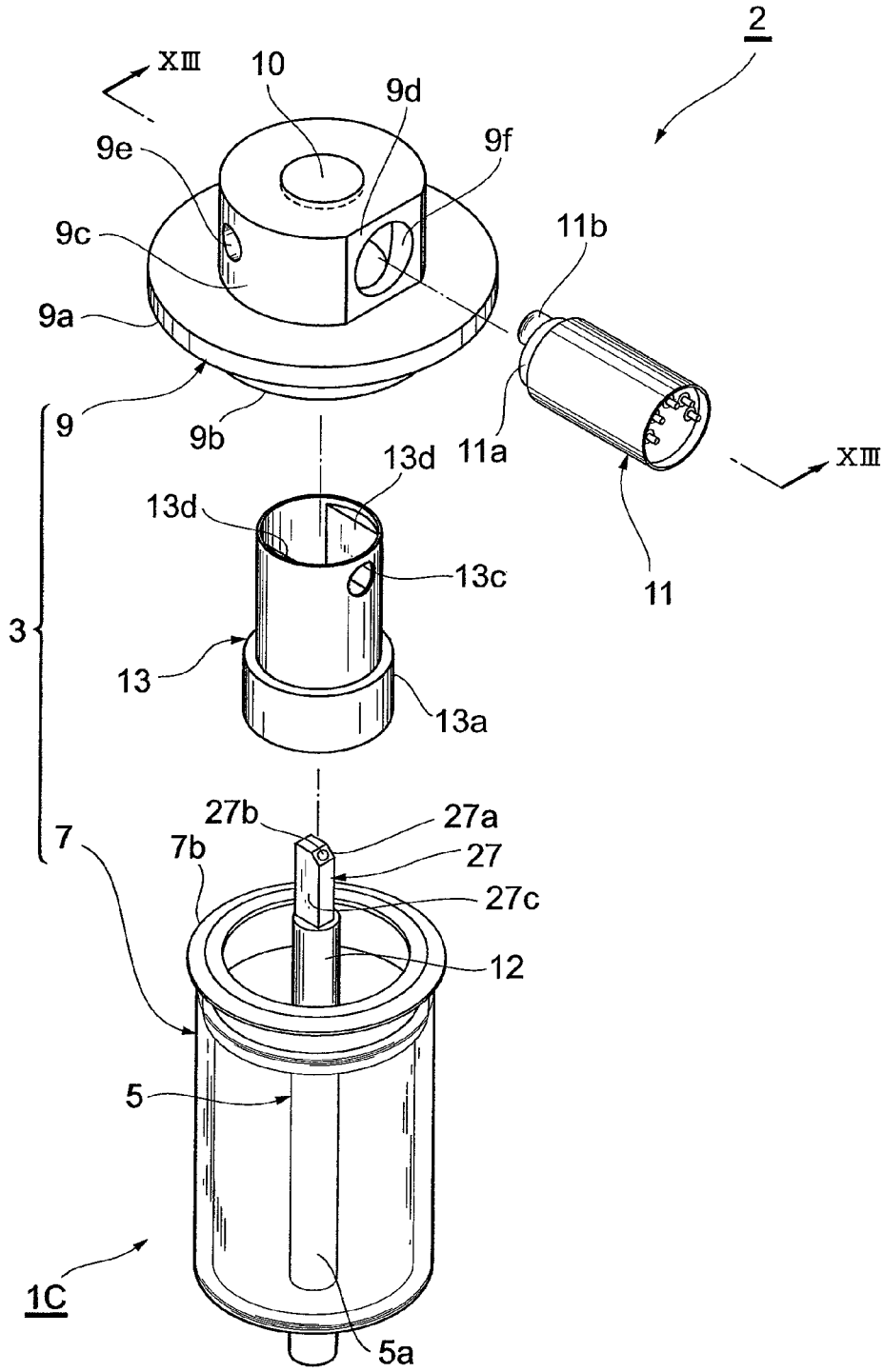
FIG. 12 is an exploded perspective view of an arrangement of a third embodiment of an X-ray tube according to the present invention.
Figure 13:
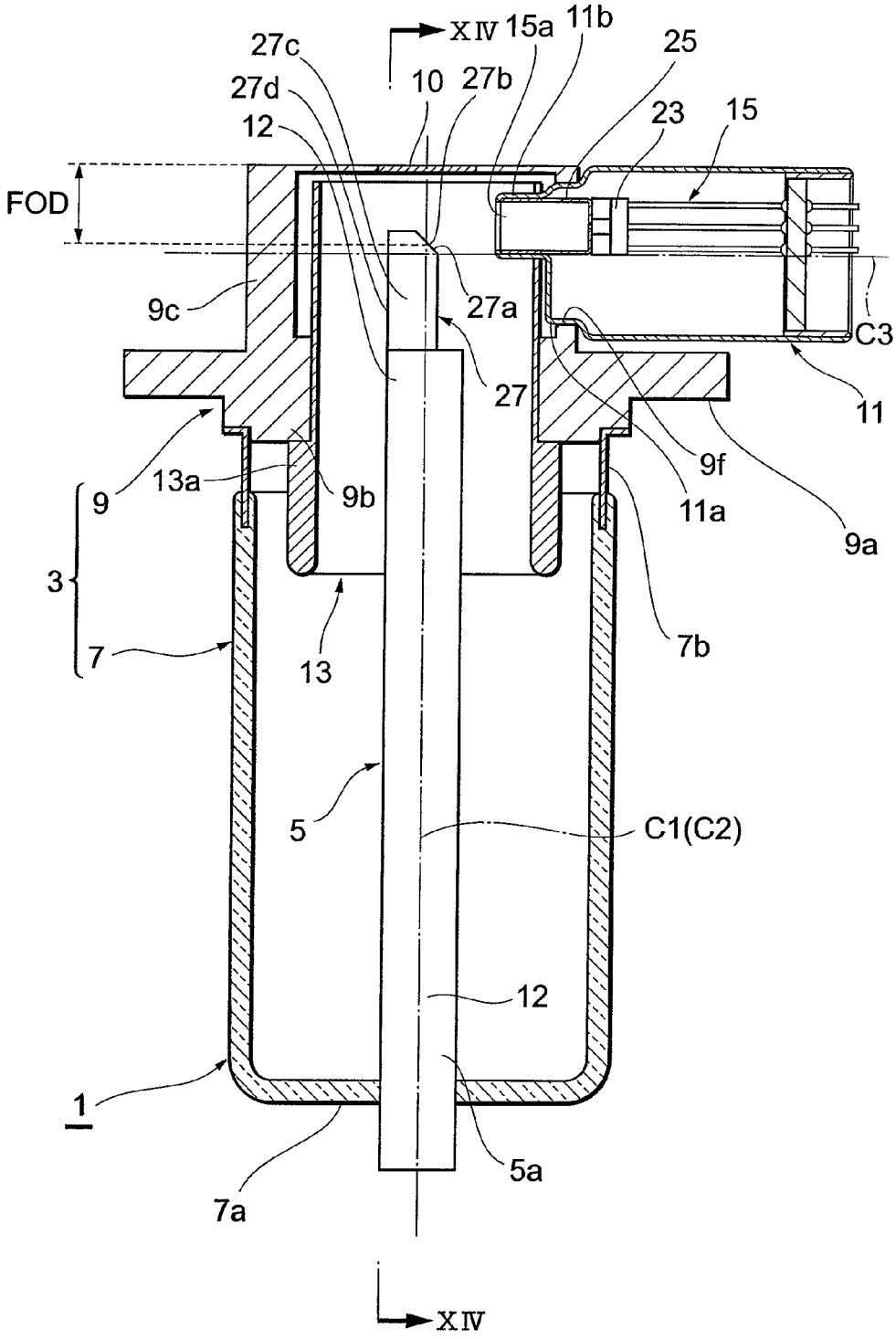
FIG. 13 is a sectional view of an internal structure of the X-ray tube according to the third embodiment taken on line XIII-XIII in FIG. 12.
Figure 14:
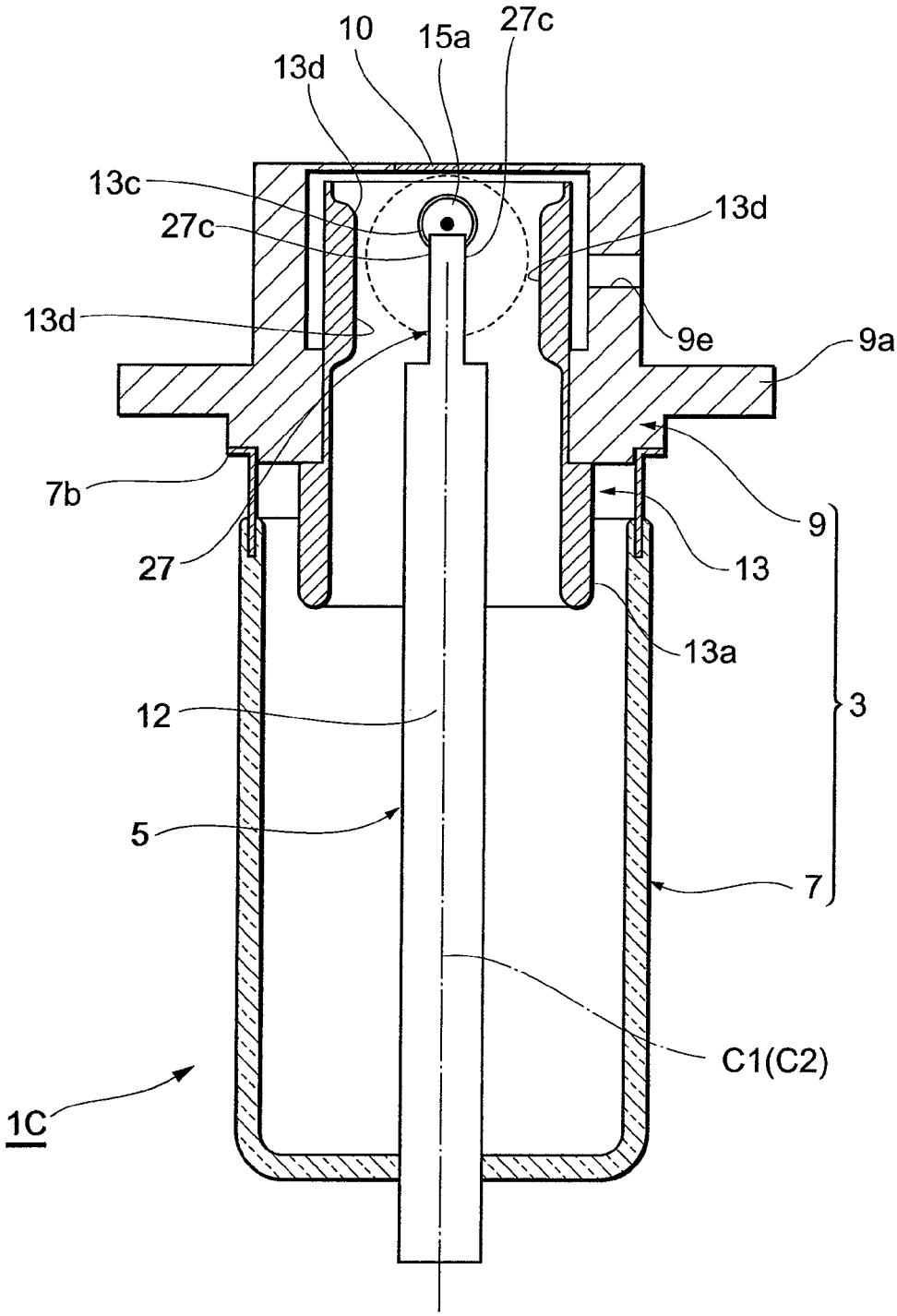
FIG. 14 is a sectional view of an internal structure of the X-ray tube according to the third embodiment taken on line XIV-XIV in FIG. 13.
Figure 15:
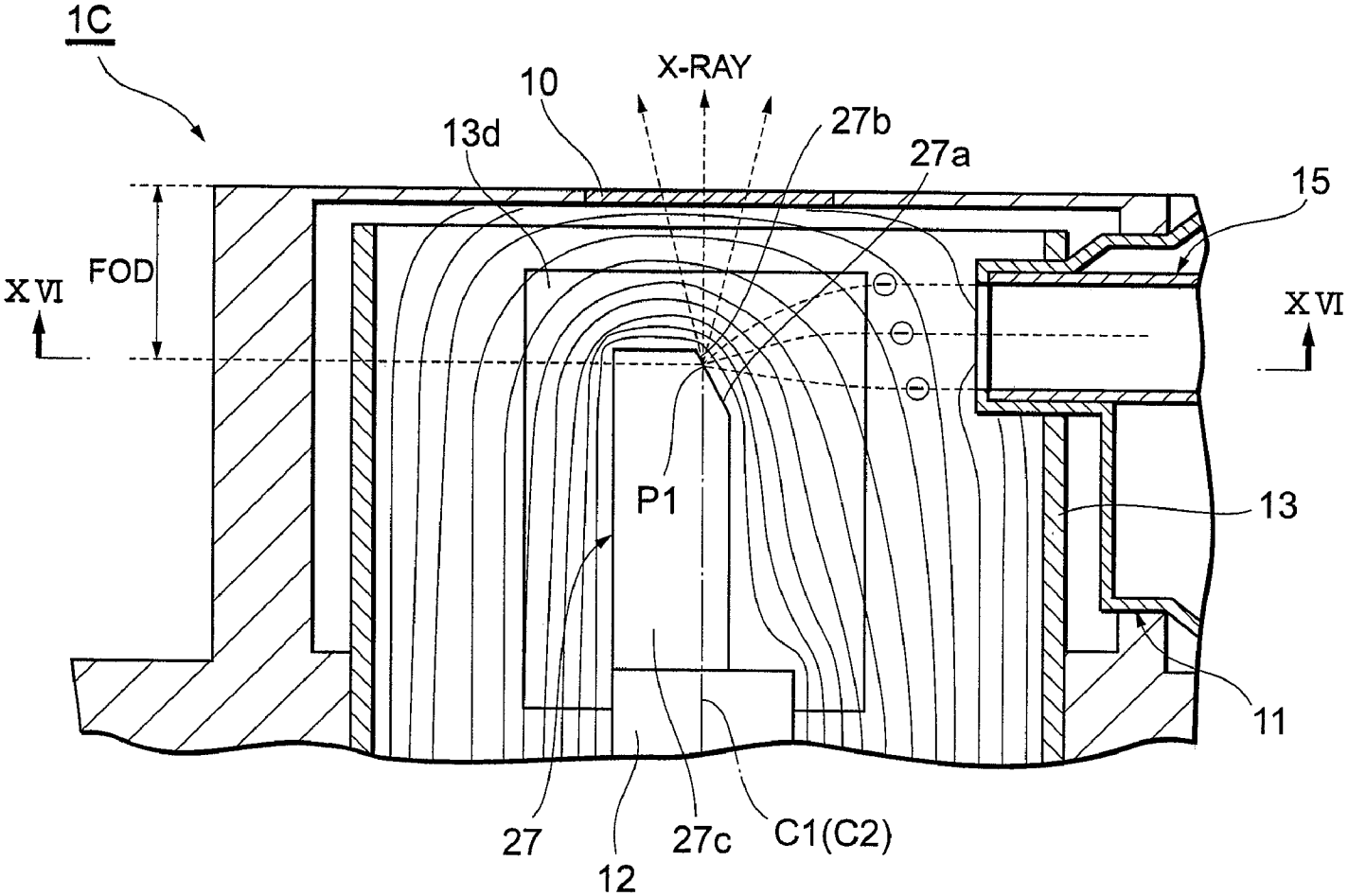
FIG. 15 is an enlarged sectional view for describing equipotential surfaces formed in a periphery of a protruding portion in the X-ray tube according to the third embodiment.
Figure 16:
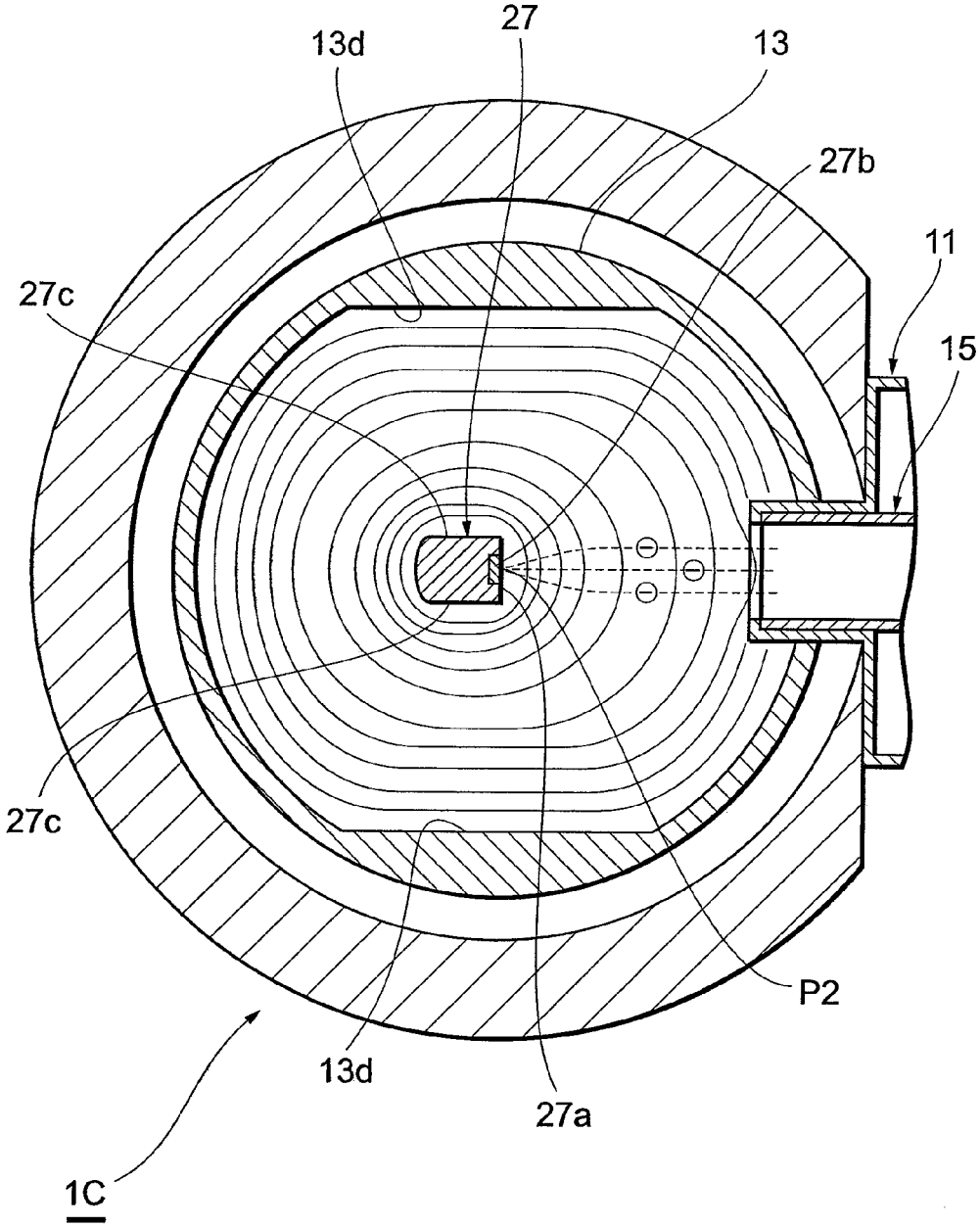
FIG. 16 is a sectional view of an internal structure of the X-ray tube according to the third embodiment taken on line XVI-XVI in FIG. 15.

Next, an X-ray tube 1C according to a third embodiment will be explained with reference to FIGS. 12 to 16. FIG. 12 is an exploded perspective view of an arrangement of the third embodiment of the X-ray tube according to the present invention. FIG. 13 is a sectional view of an internal structure of the X-ray tube 1C according to the third embodiment taken on line XIII-XIII in FIG. 12. FIG. 14 is a sectional view of an internal structure of the X-ray tube 1C according to the third embodiment taken on line XIV-XIV in FIG. 13. FIG. 15 is an enlarged sectional view for describing equipotential surfaces formed in a periphery of a protruding portion in the X-ray tube 1C according to the third embodiment. FIG. 16 is a sectional view of an internal structure of the X-ray tube 1C according to the third embodiment taken on line XVI-XVI in FIG. 15. In the X-ray tube 1C according to the third embodiment, structures that are the same as or equivalent to those of the X-ray tube 1A according to the first embodiment shall be provided with the same symbol and description thereof shall be omitted.

The X-ray tube 1C according to the third embodiment is a sealed X-ray tube and differs from the X-ray tube 1A according to the first embodiment in having an inner tube 13. The inner tube 13 is substantially cylindrical, is comprised of a conductive metal, and is disposed inside the head 9 so as to have the tube axis line C1 in common with the bulb 7 and the head 9. An upper end side in the tube axis line C1 direction of the inner tube 13 is disposed above the upper end of the protruding portion 27 of the anode 15. A pair of conductive flat portions 13*d*, having the same inwardly bulging shape, are formed on an inner wall surface of the inner tube 13, and the pair of conductive flat portions 13*d* are symmetrical in regard to the tube axis C1. The pair of conductive flat portions 13*d* oppose each other while sandwiching the protruding portion 27 of the anode 5 and are disposed parallel to the pair of side surfaces 27 formed on the protruding portion 27. The pair of conductive flat portions 13*d* must have sizes that at least cover regions, corresponding to the inclined surface 27*a*, of the pair of side surfaces 27*c* formed on the protruding portion 27. In the third embodiment, the pair of conductive flat portions 13*d* have sizes that substantially cover the pair of side surfaces 27*c*.

An inner tube side through hole 13*c*, which is smaller in diameter than the head side through hole 9*f*, is formed in the inner tube 13 for attachment of the electron gun housing unit 11. As viewed from the large-diameter head side through hole 9*f* side, the small-diameter inner tube side through hole 13*c* is positioned inside the large-diameter head side through hole 9*f* in a state of being decentered toward the X-ray emission window 10 side (see FIG. 14). The cylindrical portion 11*b* of the electron gun housing unit 11 is fitted in the inner tube side through hole 13*c* of the inner tube 13.

As shown in FIGS. 15 and 16, when a predetermined voltage is applied to respective electrodes inside the head 9, an electric field is formed in a space inside the head 9. The electrons emitted from the electron gun 15 propagate while receiving an influence of the electric field (propagate while receiving a force in directions of normals to the equipotential surfaces), and in a final stage, by incidence of the electrons onto the target 27*b* on the inclined surface 27*a*, X-rays are generated.

Because by the pair of conductive flat portions 13*d* being disposed in the inner tube 13, the electron beam focal point position P1 (FIG. 15) and the electron beam focal point position P2 (FIG. 16) can be made to be matched substantially unlike in the conventional X-ray tube 100 (see FIG. 18), the X-ray generation shape H1 is made circular readily.

The present invention is not restricted to the above-described embodiments. For example, the material of the targets 27*b* and 52*c* is not restricted to tungsten and may be any other X-ray generating material. The targets 27*b* and 52*c* are not restricted to being disposed at portions of the anodes 5 and 50, and the entireties of the anodes 5 and 50 may be formed integrally from a desired X-ray generating material so that the inclined surfaces 27*a* and 52*b* provided on the anodes 5 and 50 become the targets. "Housing" in the case of housing the anode 5 or 50 in the vacuum enclosure main body (anode housing unit) 3 is not restricted to a case of housing the entirety of the anode 5 or 50 and includes, for example, a case where a part of the anode 5 or 50 is exposed from the vacuum enclosure main body (anode housing unit) 3. The vacuum enclosure main body (anode housing unit) 3 is not restricted to a circular, tube-like shape and may have a rectangular shape or other shape instead, and is also not restricted to having a straightly extending tube-like form and may have a curved or bent tube-like form. In a case where the inner tube 13 is not to be provided, a pair of conductive flat portions, with the same structure as the pair of conductive flat portions 13*d* disposed in the inner tube 13, may be disposed directly on an inner wall surface of the head 9.

Figure 21:
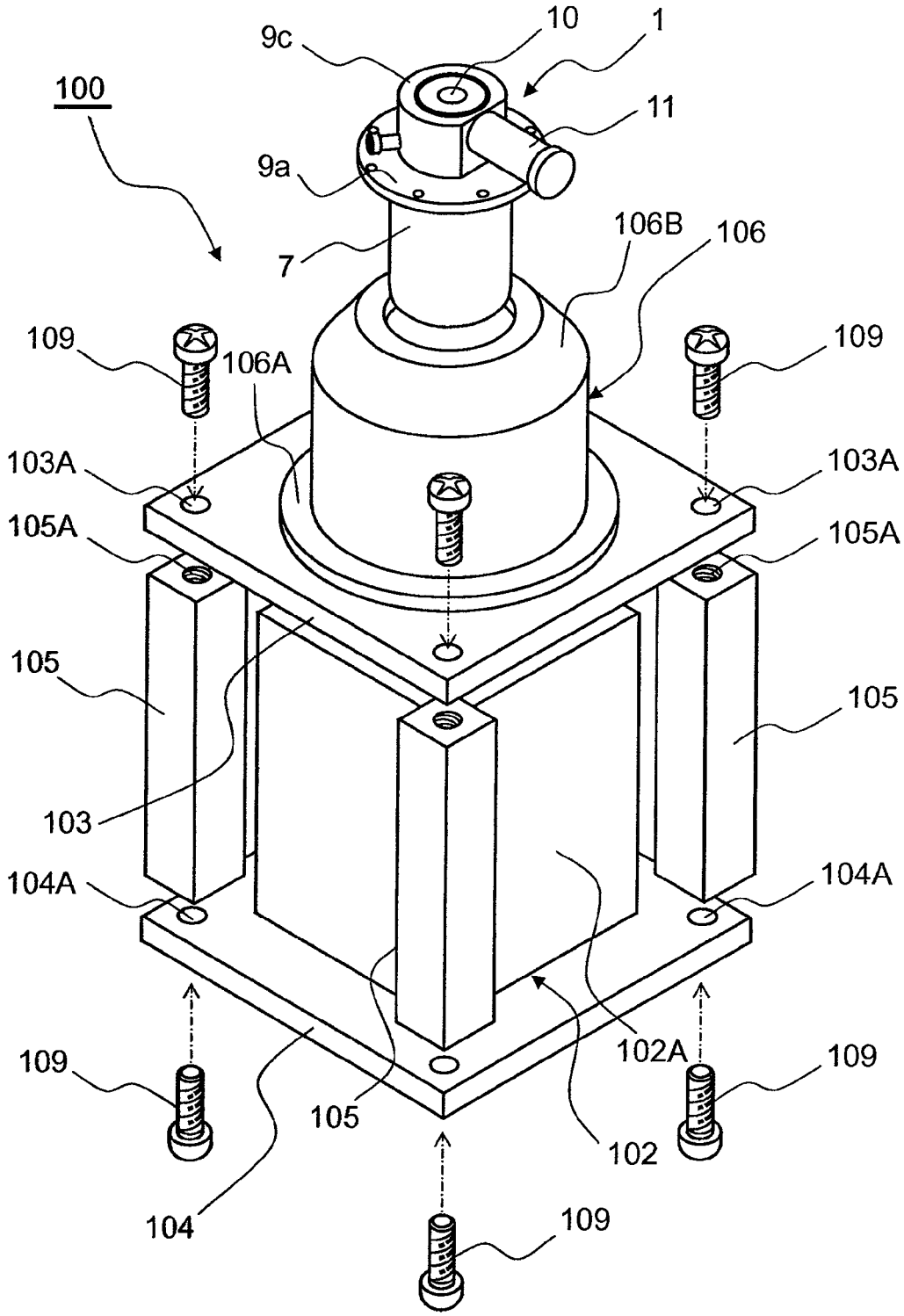
FIG. 21 is an exploded perspective view of an arrangement of an embodiment of an X-ray source according to the present invention.
Figure 22:
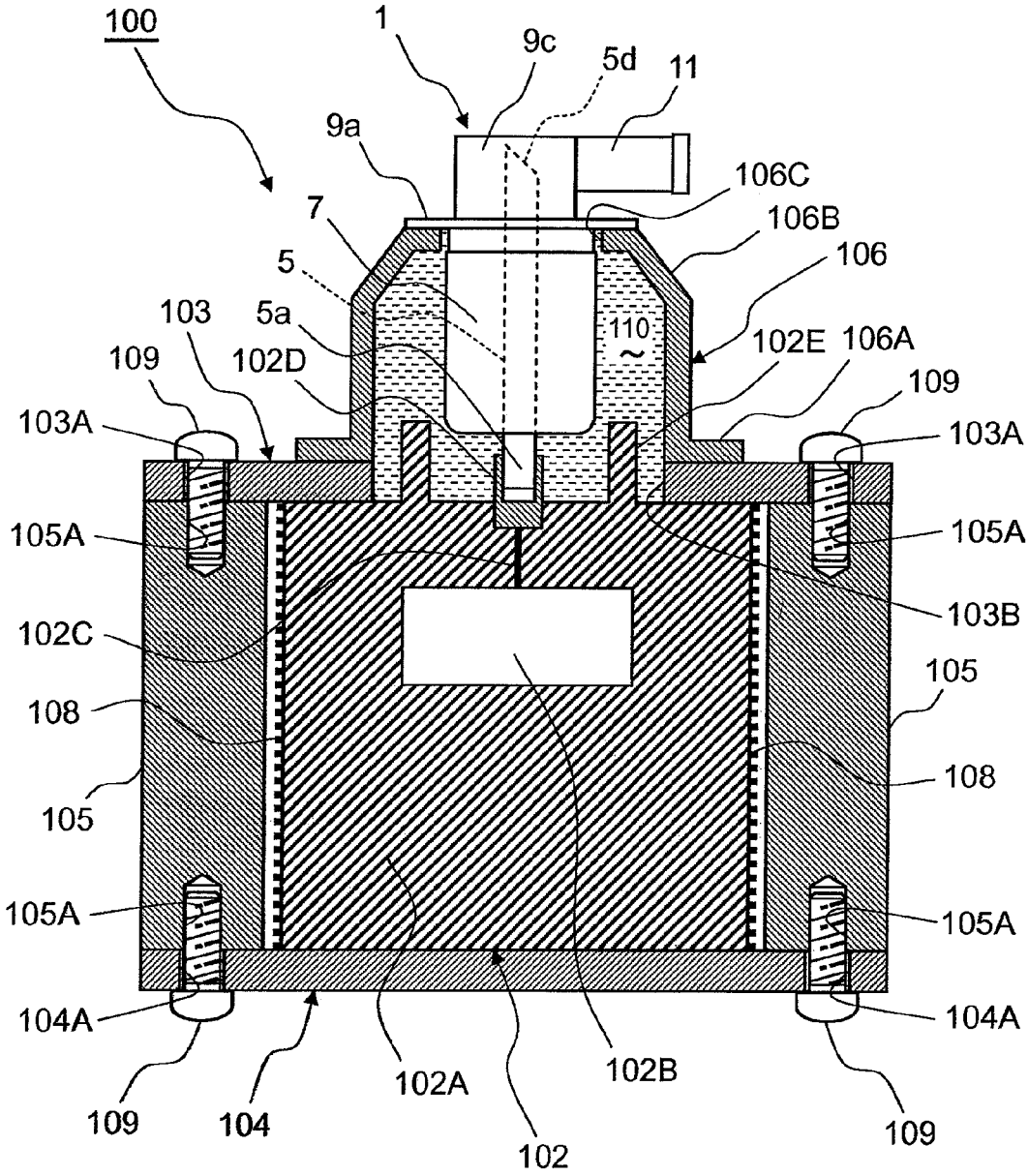
FIG. 22 is a sectional view of an internal structure of the X-ray source according to the embodiment.

An X-ray source 100 according to the present invention, to which an X-ray tube with any of the above-described structures (an X-ray tube according to the present invention) is applied, shall now be described with reference to FIGS. 21 and 22. FIG. 21 is an exploded perspective view of an arrangement of an embodiment of the X-ray source according to the present invention. FIG. 22 is a sectional view of an internal structure of the X-ray source according to the embodiment. Although any of the X-ray tubes 1A to 1C according to the first to third embodiments can be applied to the X-ray source 100 according to the present invention, for the sake of simplicity, all X-ray tubes applicable to the X-ray source 100 shall be expressed simply as "X-ray tube 1" in the description that follows and in the relevant drawings.

As shown in FIGS. 21 and 22, the X-ray source 100 includes a power supply unit 102, a first plate member 103, disposed at an upper surface side of an insulating block 102A of the power supply unit 102, a second plate member 104, disposed at a lower surface side of the insulating block 102A, four fastening spacer members 105, interposed between the first plate member 103 and the second plate member 104, and an X-ray tube 1, fixed above the first plate member 103 via a metal tubular member 106. The power supply unit 102 has a structure, with which a high voltage generating unit 102B, a high voltage line 102C, a socket 102D, etc., (see FIG. 22) are molded inside the insulating block 102A comprised of an epoxy resin.

The insulating block 102A of the power supply unit 102 has a short, rectangular column shape, with the mutually parallel upper surface and lower surface of substantially square shapes. At a central portion of the upper surface is disposed the cylindrical socket 102D, connected to the high voltage generating unit 102B via the high voltage line 102C. An annular wall portion 102E, positioned concentric to the socket 102D, is also disposed on the upper surface of the insulating block 102A. A conductive coating 108 is applied to peripheral surfaces of the insulating block 102A to make a potential thereof the GND potential (ground potential). A conductive tape may be adhered in place of coating the conductive coating.

The first plate member 103 and the second plate member 104 are members that, for example, act together with the four fastening spacer members 105 and eight fastening screws 109 to clamp the insulating block 102A of the power supply unit 102 in the vertical direction in the figure. The first plate member 103 and the second plate member 104 are formed to substantially square shapes that are larger than the upper surface and the lower surface of the insulating block 102A. Screw insertion holes 103A and 104A, for insertion of the respective fastening screws 109, are formed respectively at four corners of the first plate member 103 and the second plate member 104. A circular opening 103B, surrounding the annular wall portion 102E that protrudes from the upper surface of the insulating block 102A, is formed in the first plate member 103.

The four fastening spacer members 105 are formed to rectangular column shapes and are disposed at the four corners of the first plate member 103 and the second plate member 104. Each fastening spacer member 105 has a length slightly shorter than an interval between the upper surface and the lower surface of the insulating block 102A, that is, a length shorter than the interval by just a fastening allowance of the insulating block 102A. Screw holes 105A, into each of which a fastening screw 109 is screwed, is formed at upper and lower end surfaces of each fastening spacer member 105.

The metal tubular member 106 is formed to a cylindrical shape and has a mounting flange 106A formed at a base end thereof and fixed by screws across a sealing member to a periphery of the opening 103B of the first plate member 103. A peripheral surface at a tip of the metal tubular member 106 is formed to a tapered surface 106B. By the tapered surface 106B, the metal tubular member 106 is formed to a tapered shape without any corner portions at the tip. An opening 106C, through which a bulb 7 of the X-ray tube 1 is inserted, is formed in a flat, tip surface that is continuous with the tapered surface 106B.

The X-ray tube 1 includes the bulb 7, holding and housing the anode 5 in an insulated state, an upper portion 9*c* of the head 9, housing the reflecting type target 5*d* that is made electrically continuous with and formed at an inner end portion of the anode 5, and an electron gun housing unit 11, housing the electron gun 15 that emits an electron beam toward an electron incidence surface (reflection surface) of the target 5*d*. A target housing unit is formed by the bulb 7 and the head 9.

The bulb 7 and the upper portion 9*c* of the head 9 are positioned so as to be matched in tube axis, and these tube axes are substantially orthogonal to a tube axis of the electron gun housing unit 11. A flange 9*a*, for fixing to the tip surface of the metal tubular member 106, is formed between the bulb 7 and the upper portion 9*c* of the head 9. A base end 5*a* (portion at which a high voltage is applied from the power supply unit 102) of the anode 5 protrudes downward from a central portion of the bulb 7 (see FIG. 22).

An exhaust tube is attached to the X-ray tube 1, and a sealed vacuum container is formed by interiors of the bulb 7, the upper portion 9*c* of the head 9, and the electron gun housing unit 11 being depressurized to a predetermined degree of vacuum via the exhaust tube.

In the X-ray tube 1, the base end 5*a* (high voltage application portion) is fitted into the socket 102D molded in the insulating block 102A of the power supply unit 102. High voltage is thereby supplied from the high voltage generating unit 102B and via the high voltage line 102C to the base end 5*a*. When in this state, the electron gun 15, incorporated in the electron gun housing unit 11, emits electrons toward the electron incidence surface of the target 5*d*, X-rays, generated by the incidence of the electrons from the electron gun 15 onto the target 5*d*, are emitted from an X-ray emission window 10, fitted into an opening of the upper portion 9*c* of the head 9.

Here, the X-ray source 100 is assembled, for example, by the following procedure. First, the four fastening screws 109, inserted through the respective screw insertion holes 104A of the second plate member 104, are screwed into the respective screw holes 105A at the lower end surfaces of the four fastening spacer members 105. And by the four fastening screws 109, inserted through the respective screw insertion holes 103A of the first plate member 103, being screwed into the respective screw holes 105A at the upper end surfaces of the four fastening spacer members 105, the first plate member 103 and the second plate member 104 are mutually fastened while clamping the insulating block 102A in the vertical direction. A sealing member is interposed between the first plate member 103 and the upper surface of the insulating block 102A, and likewise, a sealing member is interposed between the second plate member 104 and the lower surface of the insulating block 102A.

A high voltage insulating oil 110, which is a liquid insulating substance, is then injected into an interior of the metal tubular member 106 from the opening 106C of the metal tubular member 106 that is fixed above the first plate member 103. The bulb 7 of the X-ray tube 1 is then inserted from the opening 106C of the metal tubular member 106 into the interior of the metal tubular member 106 and immersed in the high voltage insulating oil 110. In this process, the base end 5*a* (high voltage application portion) that protrudes downward from the central portion of the bulb 7 is fitted into the socket 102D at the power supply unit 102 side. The flange 9*a* of the X-ray tube 1 is then fixed by screwing across the sealing member onto the tip surface of the metal tubular member 106.

In the X-ray source 100, assembled by the above process, the annular wall portion 102E, protruded from the upper surface of the insulating block 102A of the power supply unit 102, and the metal tubular member 106 are positioned concentric to the anode 5 of the X-ray tube 1 as shown in FIG. 22. Also, the annular wall portion 102E protrudes to a height of surrounding and shielding the periphery of the base end 5*a* (high voltage application portion), which protrudes from the bulb 7 of the X-ray tube 1, from the metal tubular member 106.

In the X-ray source 100, when a high voltage is applied to the base end 5*a* of the X-ray tube 1 from the high voltage generating unit 102B of the power supply unit 102 and via the high voltage line 102C and the socket 102D, the high voltage is supplied to the target 5*d* via the anode 5. When in this state, the electron gun 15, housed in the electron gun housing unit 11, emits electrons toward the electron incidence surface of the target 5*d*, housed in the upper portion 9*c* of the head 9, the electrons become incident on the target 5*d*. The X-rays that are thereby generated at the target 5*d* are emitted to the exterior via the X-ray emission window 10, fitted onto the opening of the upper portion 9*c* of the head 9.

Here, in the X-ray source 100, the metal tubular member 106, housing the bulb 7 of the X-ray tube 1 in a state of being immersed in the high voltage insulating oil 110, is protruded from and fixed above the exterior of the insulating block 102A of the power supply unit 2, that is, the first plate member 103. A good heat dissipating property is thus realized, and heat dissipation of the high voltage insulating oil 110 inside the metal tubular member 106 and the bulb 7 of the X-ray tube 1 can be promoted.

The metal tubular member 106 has a cylindrical shape with the anode 5 disposed at the center. In this case, because the distance from the anode 5 to the metal tubular member 106 is made uniform, an electric field formed in a periphery of the anode 5 and the target 5*d* can be stabilized. The metal tubular member 106 can thus effectively discharge charges of the charged high voltage insulating oil 110.

Furthermore, the annular wall portion 102E, protruded on the upper surface of the insulating block 102A of the power supply unit 102, surrounds the periphery of the base end 5*a* (high voltage application portion), protruding from the bulb 7 of the X-ray tube 1, and thereby shields the base end 5*a* from the metal tubular member 106. Abnormal discharge from the base end 5*a* to the metal tubular member 106 is thus prevented effectively.

The X-ray source 100 has the structure with which the insulating block 102A of the power supply unit 102 is clamped between the first plate member 103 and the second plate member 104 that are fastened to each other via the four fastening spacer members 105. This means that conductive foreign objects that can induce discharge and charged foreign objects that can induce disruption of electric field are not present inside the insulating block 102A. Thus, in the X-ray source 100 according to the present invention, unwanted discharge phenomena and electric field disruptions in the power supply unit 102 are suppressed effectively.

Figure 23:
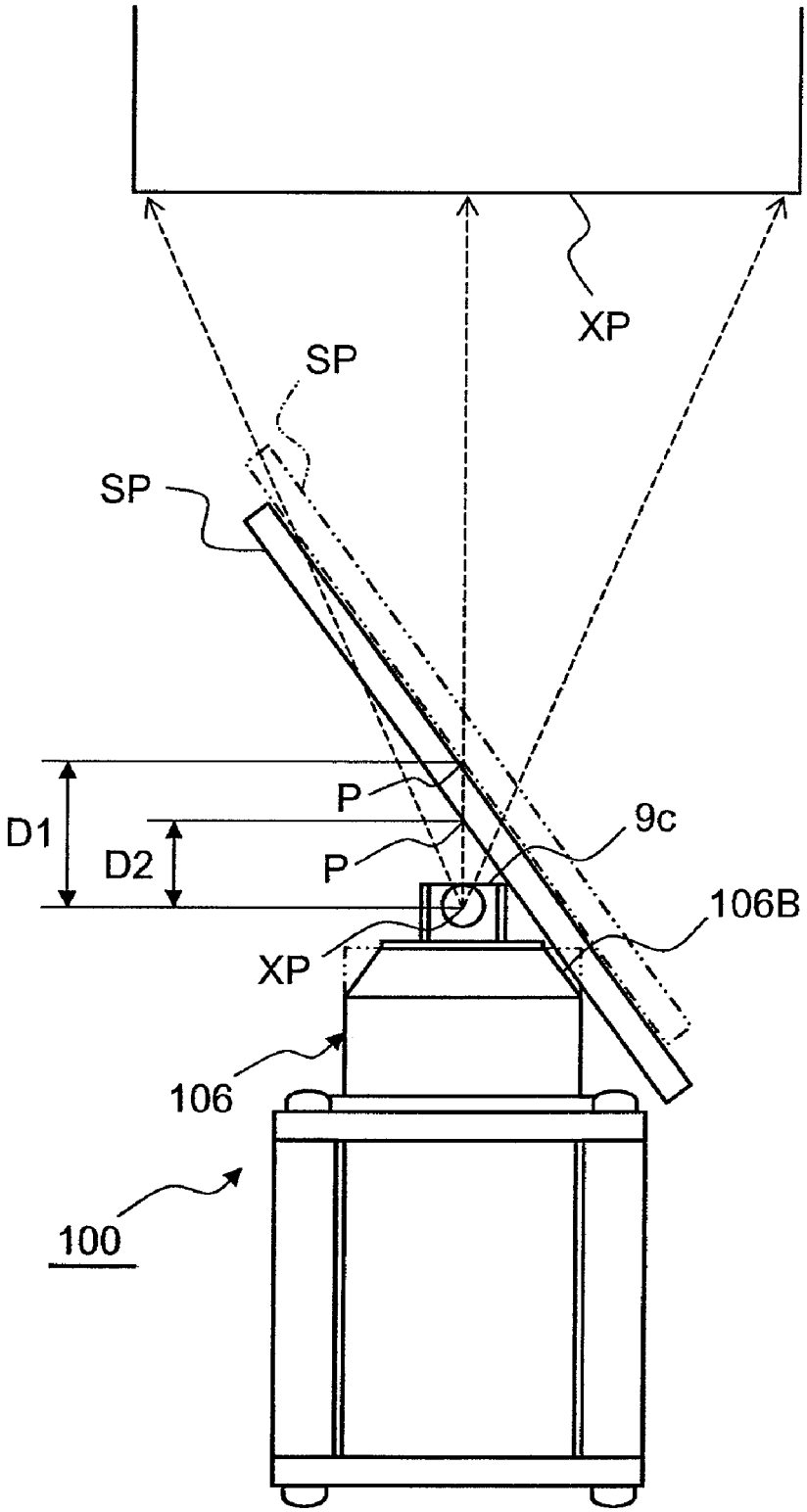
FIG. 23 is a front view for describing actions of the X-ray source (including the X-ray tube according to the embodiment) incorporated in an X-ray generating apparatus of a nondestructive inspection apparatus.

Here, the X-ray source 100 is incorporated and used, for example, in an X-ray generating apparatus that irradiates X-rays onto a sample in a nondestructive inspection apparatus, with which an internal structure of the sample is observed in the form of a transmission image. FIG. 23 is a front view for describing actions of an X-ray source (including the X-ray tube according to the embodiment) that is incorporated, as a usage example of the X-ray source 100, in an X-ray generating apparatus of a nondestructive inspection apparatus.

The X-ray source 100 irradiates X-rays to a sample plate SP, positioned between an X-ray camera XC and the X-ray source 100. That is, the X-ray source 100 irradiates X-rays onto the sample plate SP through the X-ray emission window 10 from an X-ray generation point XP of the target 5*d*, incorporated in the upper portion 9*c* of the head 9 that protrudes above the metal tubular member 106.

In such a usage example, because the shorter the distance from the X-ray generation point XP to the sample plate SP, the greater the magnification factor of the transmission image of the sample plate SP taken by the X-ray camera XC, the sample plate SP is normally positioned close to the X-ray generation point XP. Also, to observe the internal structure of the sample plate SP three-dimensionally, the sample plate SP is inclined around an axis orthogonal to a direction of irradiation of the X-rays.

If, when an observation point P of the sample plate SP is to be observed three-dimensionally upon being brought close to the X-ray generation point XP while inclining the sample plate SP around the axis orthogonal to the direction of irradiation of the X-rays as shown in FIG. 23, corner portions, such as indicated by alternate long and two short dashes lines, are left at a tip of the metal tubular member 106 of the X-ray source 100, the observation point P of the sample plate SP can be made to approach the X-ray generation point XP only up to a distance, with which the sample plate SP contacts a tip corner portion of the metal tubular member 106, that is, only up to a distance at which a distance from the X-ray generating point XP to the observation point P becomes D1.

On the other hand, in the X-ray source 100, with which the tip of the metal tubular member 106 is configured to have a tapered shape without a corner portion by the provision of the tapered surface 106B as shown in FIGS. 21 and 22, the observation point P of the sample plate SP can be made to approach the X-ray generation point XP to a distance, with which the sample plate SP contacts the tapered surface 106B of the metal tubular member 106 as indicated by solid lines FIG. 23, that is, to a distance at which the distance from the X-ray generating point XP to the observation point P becomes D2. As a result, the transmission image of the observation point P of the sample plate SP can be magnified further and nondestructive inspection of the observation point P can be performed more precisely.

The X-ray source 100 according to the present invention is not restricted to the above-described embodiment. For example, although a cross-sectional shape of an inner peripheral surface of the metal tubular member 106 is preferably circular, a cross-sectional shape of an outer peripheral surface of the metal tubular member 106 is not restricted to being circular and may be a rectangular shape or other polygonal shape. In this case, the peripheral surface of the tip of the metal tubular member can be formed to be an inclined surface.

The insulating block 102A of the power supply unit 102 may have a short, cylindrical shape, and the first plate member 103 and the second plate member 104 may correspondingly have disk shapes. The fastening spacer members 105 may have cylindrical shapes and the number thereof is not restricted to four.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The X-ray tube according to the present invention can be applied as an X-ray generating source in various X-ray imaging apparatuses that are frequently used for nondestructive, noncontact observations.

The invention claimed is:

1. An X-ray tube comprising:

an anode housing unit having an X-ray emission window for taking out X-rays generated therein an internal portion;

an anode, disposed inside said anode housing unit, having an X-ray target;

an electron gun for emitting electrons toward said X-ray target to generate X-rays in a direction from said X-ray target toward said X-ray emission window;

an electron gun housing unit in which said electron gun is housed; and a metal cylindrical member housing a part of said anode in which said X-ray target is included, wherein said anode has a main body having a shape extending along a predetermined axis orthogonal to an electron incidence direction from said electron gun, and a protruding portion extending in the axis line direction of said main body from a tip of said main body, wherein said protruding portion has an inclined surface that intersects the axis line at a predetermined angle and matches an electron incidence surface of said X-ray target, a pair of side surfaces that extend in the same direction as the axis line and are disposed in parallel while sandwiching said inclined surface, and a rear surface that is sandwiched by said pair of side surfaces and is positioned at an opposite side of said electron gun housing unit with respect to said inclined surface, wherein a distance between said pair of side surfaces of said protruding portion is shorter than a width of said main body in the same direction as the distance, wherein said metal cylindrical member has a through hole for installation of said electron gun housing unit and is arranged so as for an inner surface thereof to surround a stepped portion constituted by said tip of said main body and at least said pair of side surfaces of said protruding portion, and wherein said rear surface of said protruding portion and an outer surface of said main body constitute a consecutive curved surface with no stepped portion.

2. An X-ray tube according to claim 1, wherein, in a cross section of said protruding portion orthogonal to the axis line, a lateral dimension of the cross section of said protruding portion along a direction orthogonal to said pair of side surfaces is shorter than a longitudinal dimension of the cross section of said protruding portion along a direction orthogonal to the lateral dimension.

3. An X-ray tube according to claim 1, wherein a part of the surface of said protruding portion is formed flush to a surface of said main body.

4. An X-ray tube according to claim 1, wherein said anode housing unit has a pair of conductive flat portions disposed so as to be in parallel to said pair of side surfaces of said protruding portion and so as to oppose each other while sandwiching said protruding portion.

5. An X-ray tube according to claim 1, wherein said electron gun has a circular electron emission exit on a surface facing said X-ray target.

6. An X-ray source comprising:

an X-ray tube according to claim 1; and a power supply unit supplying a voltage to said X-ray target.

7. An X-ray tube according to claim 1, wherein said metal cylindrical member constitutes a part of said anode housing unit.

8. An X-ray tube according to claim 1, wherein said metal cylindrical member is held by said anode housing unit while being housed in said anode housing unit.

9. An X-ray tube according to claim 1, wherein, on said inclined surface of said protruding portion, said X-ray target is arranged such that a center of said X-ray target is shifted to the X-ray emission window side with respect to a center of said inclined surface.

* * * * *